US008595992B2

(12) United States Patent
May et al.

(10) Patent No.: US 8,595,992 B2
(45) Date of Patent: Dec. 3, 2013

(54) HIGH-VISIBILITY ROOF-DRAIN COVER

(76) Inventors: Scott Arthur May May, West Bridgewater, MA (US); Linda May, West Bridgewater, MA (US)

( * ) Notice: Subject to any disclaimer, the term of this patent is extended or adjusted under 35 U.S.C. 154(b) by 434 days.

(21) Appl. No.: 12/803,951

(22) Filed: Jul. 9, 2010

(65) Prior Publication Data

US 2011/0030284 A1 Feb. 10, 2011

Related U.S. Application Data

(63) Continuation-in-part of application No. 12/589,739, filed on Oct. 28, 2009, now abandoned.

(60) Provisional application No. 61/212,429, filed on Apr. 10, 2009.

(51) Int. Cl.
*E04D 13/00* (2006.01)

(52) U.S. Cl.
CPC ..... *E04D 13/00* (2013.01)
USPC ..... 52/105; 52/302.1

(58) Field of Classification Search
USPC ..... 52/103, 105, 302.1; 210/163; 285/42
See application file for complete search history.

(56) References Cited

U.S. PATENT DOCUMENTS

| | | | | |
|---|---|---|---|---|
| 3,044,435 | A * | 7/1962 | Reardon | 116/209 |
| 3,166,041 | A * | 1/1965 | Caggainello | 116/209 |
| 7,108,783 | B2 * | 9/2006 | Glazik | 210/163 |
| 7,591,111 | B2 * | 9/2009 | Froeter et al. | 52/302.1 |

* cited by examiner

*Primary Examiner* — Mark Wendell
*Assistant Examiner* — Matthew J Smith
(74) *Attorney, Agent, or Firm* — John L. Lee

(57) ABSTRACT

The invention provides a high-visibility roof-drain cover comprising a roof-drain cover, a marked, reversible, elongated flag, and coupler means for mounting the flag to the roof-drain cover, wherein the flag extends upwardly from the roof-drain cover a sufficient distance that a top portion of the flag will remain visible above an accumulation of wind-blown debris and snow. The invention provides a first group of high-visibility roof-drain cover embodiments, each of which includes a novel roof-drain cover. The invention provides a second group of high-visibility roof-drain cover embodiments for retrofit, each of which includes a prior art roof-drain cover. The invention provides a third group of sub-assemblies for retrofit.

30 Claims, 27 Drawing Sheets

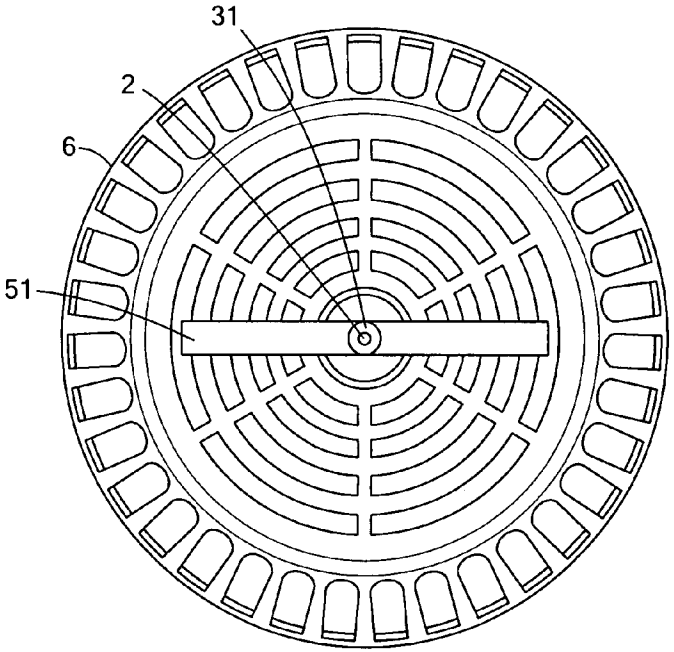
FIG. 16C
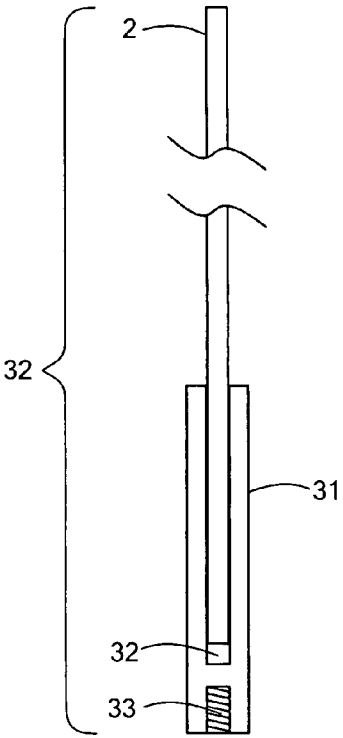
FIG. 16B
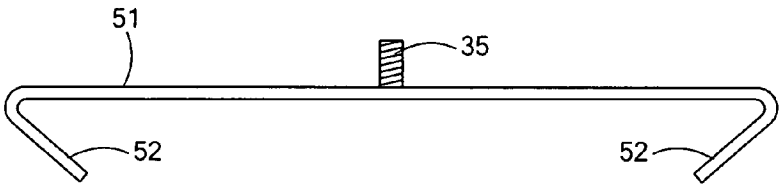

Section A-A

HIGH-VISIBILITY ROOF-DRAIN COVER

This application is a Continuation-in-Part application that claims priority to co-owned, U.S. provisional application Ser. No. 61/212,429, filed Apr. 10, 2009, co-owned, U.S. patent application Ser. No. 12/589,739, filed Oct. 28, 2009, now abandoned, and co-owned, Canadian patent application, serial no. 2,696,453, filed Mar. 12, 2010.

FIELD OF THE INVENTION

This invention relates generally to the maintenance of roof-drains in large buildings, and in particular to the practice of regular scheduled inspection of every roof-drain on the building, and the unblocking of every roof-drain that is found to be wholly or partially blocked.

BACKGROUND OF THE INVENTION

It is common practice for commercial property owners to require roof-top inspections at suitable intervals of flat roofs having roof drains. When properly conducted, such inspections followed by diligent removal of accumulated ice and debris prevent the drains from becoming blocked, so that water is allowed to drain away before it does damage. Inspections are required both during construction of the building, and during the useful life of the building.

A significant problem arising when conducting these inspections is that roof-drains can become invisible when covered by either wind-blown leaves during the fall season, or when even moderate amount of snow accumulate during the winter. Quite often, inspectors find themselves walking around the roof-top on its ice-covered, snow-covered, or leaf-covered surfaces, not entirely sure whether or not they have found all of the roof-drains on that particular roof. Also, searching ice-covered roof-tops is, by its nature dangerous. So inspectors often find themselves guessing where the drains might be, based on prior experiences with similar commercial roofs. This is especially true when a roof is covered with six or more inches of snow. Such difficulties leave much room for error. Many drains are not found. Roof-drains that are not found are not inspected, and consequently are not cleared.

The lack of a roof-drain inspection can be catastrophic. When roof-drains are not cleared of ice and debris after a snow storm, the snow that melts during the day deposits water onto areas of the roof where it is not meant to collect. Water that does not drain properly refreezes. This causes damage to roof seams and prior roof repairs. Such damage causes various kinds of roof leaks. In foreseeable worst-case scenarios, a roof can become so compromised with damage that it becomes a safety hazard, posing such dangers as falling ceiling tiles, full ceiling collapse, partial roof collapse, and even collapse of a complete roof. Thus, failure to reliably find, inspect and clear every roof-drain on the roof of a large building can cause significant physical damage to the building. Such risks can justify high insurance premiums. Such risks can also constitute a breach of public safety resulting in law suits. Even worse than physical damage to a building, or incurring financial loss, collapse of a complete roof can cause people in or on the building to suffer serious injury or death.

SUMMARY OF THE INVENTION

FIG. 1 shows a first preferred embodiment of a high-visibility roof-drain cover. The high-visibility roof-drain cover includes a novel roof-drain cover defining coupler means in the form of a boss, for mounting a flag to the roof-drain cover.

The flag is preferably a marked, reversible, elongated flag. The flag extends upwardly from the roof-drain cover a sufficient distance that a top portion of the flag will remain visible above an accumulation of wind-blown debris and snow.

FIGS. 1-5 show the boss defining a cavity sized to accept a base portion of a marked, reversible, elongated flag. The flag defines a first flag end and a second flag end. The first flag end is up when the second flag end is mounted to the roof-drain cover. The second flag end is up when the first flag end is mounted to the roof-drain cover. At least one of the flag ends is visibly marked so that "first flag end up" is visibly distinguishable over "second flag end up. So reversing the orientation of the flag, after an inspecting the roof-drain-cover, provides a visual indication that an inspection has been performed.

FIGS. 8A and 8B show an embodiment having a short boss wherein a flag is secured in the cavity by push-fit. FIGS. 8A and 8C show a flag secured in the cavity by adhesive, preferably epoxy. FIGS. 8D and 8E show an embodiment having a flag secured in the cavity by a corrugated-shell radial locking-spring. FIG. 8E shows a corrugated-shell radial locking-spring. In another alternative embodiment (no FIG.), the base of the flag may be secured within the cavity by a locking screw that is screwed through a threaded pilot hole in a wall surrounding the cavity such that the base of the flag may be locked in place.

FIGS. 9-11 show two other embodiments, in which the boss is a shoulder boss located proximate to one side of the novel roof-drain cover.

FIGS. 12-14 show a second preferred embodiment that provides a retrofit high-visibility roof-drain cover. The retrofit high-visibility roof-drain cover comprises a prior art roof-drain cover, a flag, and attachment parts, including coupler strip 34, for attaching the flag to the prior art roof-drain cover.

FIG. 15 shows one alternative to the second preferred embodiment, in which the coupler strip is attached to the flag coupler by spot welding.

FIGS. 16A-16C show another alternative embodiment, in which the coupler strip is an elongated spring-tab strip having spring-tab ends that pass through top apertures in the roof-drain cover.

FIGS. 17A-17C show another alternative embodiment, in which the coupler strip is an elongated twist-tab strip having twist-tabs ends that pass through top apertures in the roof-drain cover, and twist tab ends are twisted.

FIGS. 18A-18C show another alternative embodiment, in which the coupler strip is an elongated spring-arm strip having spring-arm ends that pass through sidewall apertures in the roof-drain cover.

FIGS. 19A-19C show another alternative embodiment, in which rib-clasps are inserted into an aperture between two ribs to attach the coupler means to the roof-drain cover, and the flag is mounted to the roof-drain cover by a roll-up flag-grip.

FIGS. 20A-20B show an alternative embodiment to the embodiment of FIGS. 19A-19C, in which the means for mounting the flag to the roof-drain cover includes flag clasps.

FIGS. 21A-21B show another alternative embodiment, in which the coupler means includes a boss defining a cavity sized to accept a base portion of the flag therein, and a rigid structure defining a base with a peripheral rim, the rigid structure being adapted to support the boss, the base being sufficiently concave to fit over a convex upper portion of a roof-drain cover, and at least one locking fastener for fastening the peripheral rim to the roof-drain cover.

FIGS. 22A-22B show another alternative embodiment, in which the coupler means is a shaped-wire flag coupler that defines a coil-grip portion for gripping a base portion of the flag, and a locking portion for locking the shaped-wire coupler to the roof-drain cover such that the flag is held in a substantially vertical orientation.

BRIEF DESCRIPTION OF THE DRAWINGS

FIG. 16B shows the attachment parts of the embodiment of FIG. 16A.

FIG. 16C is a top view of the embodiment of FIG. 16A.

FIG. 23B shows a perspective, partial cut-away view of drain bowl 130.

DETAILED DESCRIPTION OF THE INVENTION

In a first preferred embodiment, the invention provides a high-visibility roof-drain cover comprising a roof-drain cover, a marked, reversible, elongated flag, and a novel coupler means for mounting the flag to the roof-drain cover, wherein the flag extends upwardly from the roof-drain cover a sufficient distance that a top portion of the flag will remain visible above an accumulation of wind-blown debris and snow.

Each of a first group of claimed embodiments (FIGS. 1-11) provide a novel roof-drain cover having a boss for mounting a marked, reversible elongated flag. Each of a second group of claimed embodiments (FIGS. 12-22B) provides a prior art roof-drain cover with a novel retrofit flag coupler for mounting the marked, reversible elongated flag to the prior art roof-drain cover. Each of several subassemblies in a third group support low transportation-cost retrofit capability.

Preferred Embodiment

A preferred embodiment of the invention, a high-visibility roof-drain cover, is shown in FIGS. 1-5.

Figure 1:
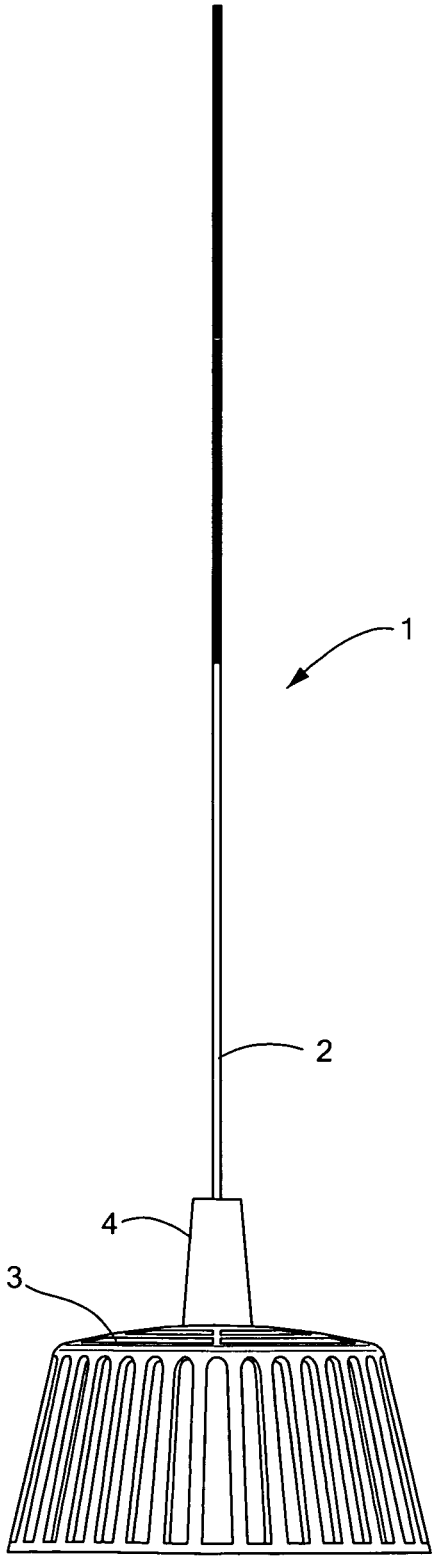
FIG. 1 shows a first preferred embodiment of a high-visibility roof-drain cover with an elongated marked flag. The high-visibility roof-drain cover includes novel roof-drain cover that defines apertures and coupler means. The coupler means, shown as boss, mounts the flag to the roof-drain cover.

Referring first to FIG. 1, high-visibility roof-drain cover 1 includes a novel marked, reversible, elongated flag 2, a novel roof-drain cover 3, and coupler means for mounting marked, reversible, elongated flag 2 to roof-drain cover 3.

Flag 2 is preferably a fiberglass, post-type flag, sized approximately 48 inches long and ⅜ inch diameter. Preferably, the flag has a lower end that is white and an upper end marked black. Alternatively, the flag may be treated with fluorescent red or other colored paint.

Figure 2:
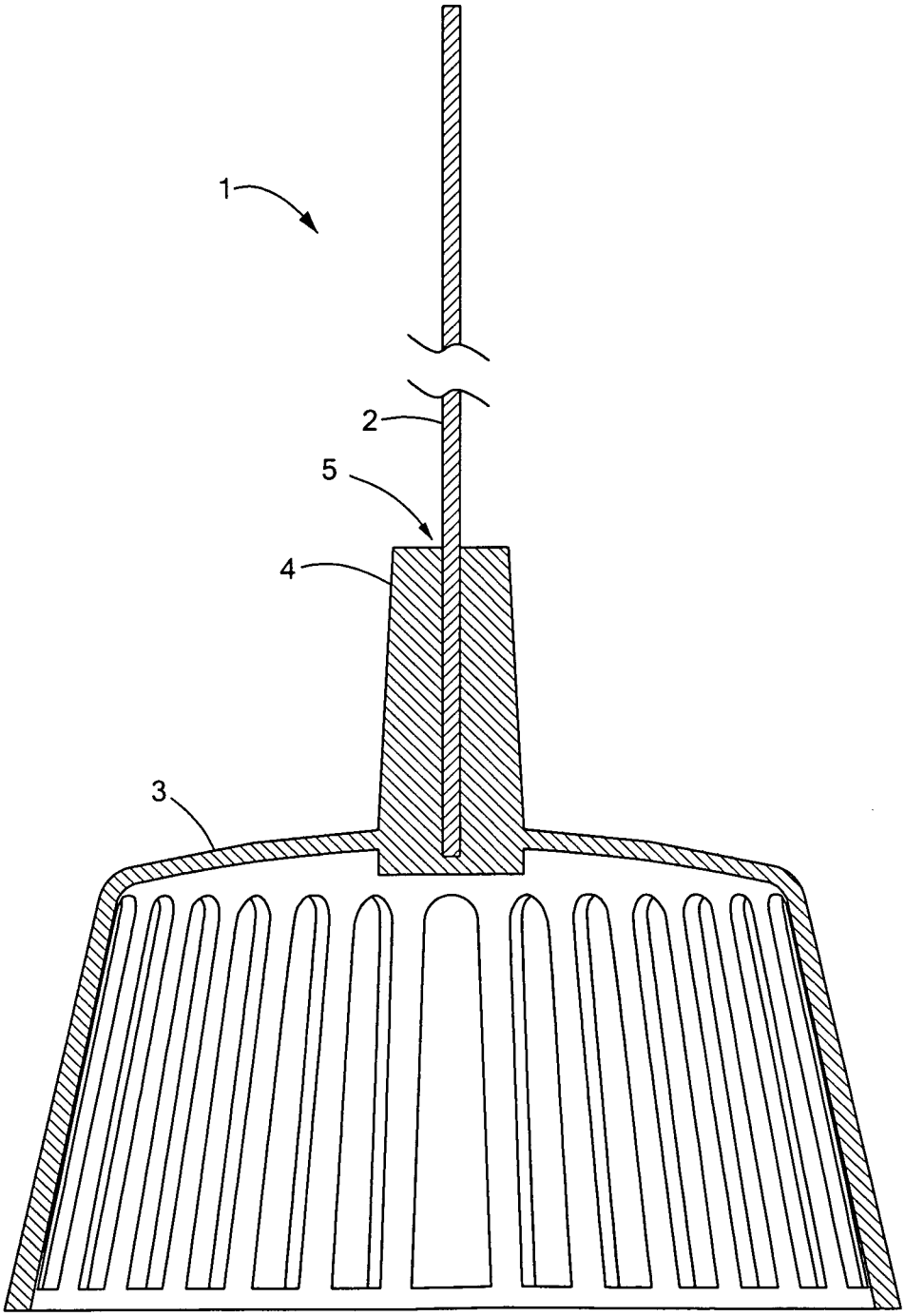
FIG. 2 is a cross-section view of the embodiment of FIG. 1, showing the cavity.
Figure 4:
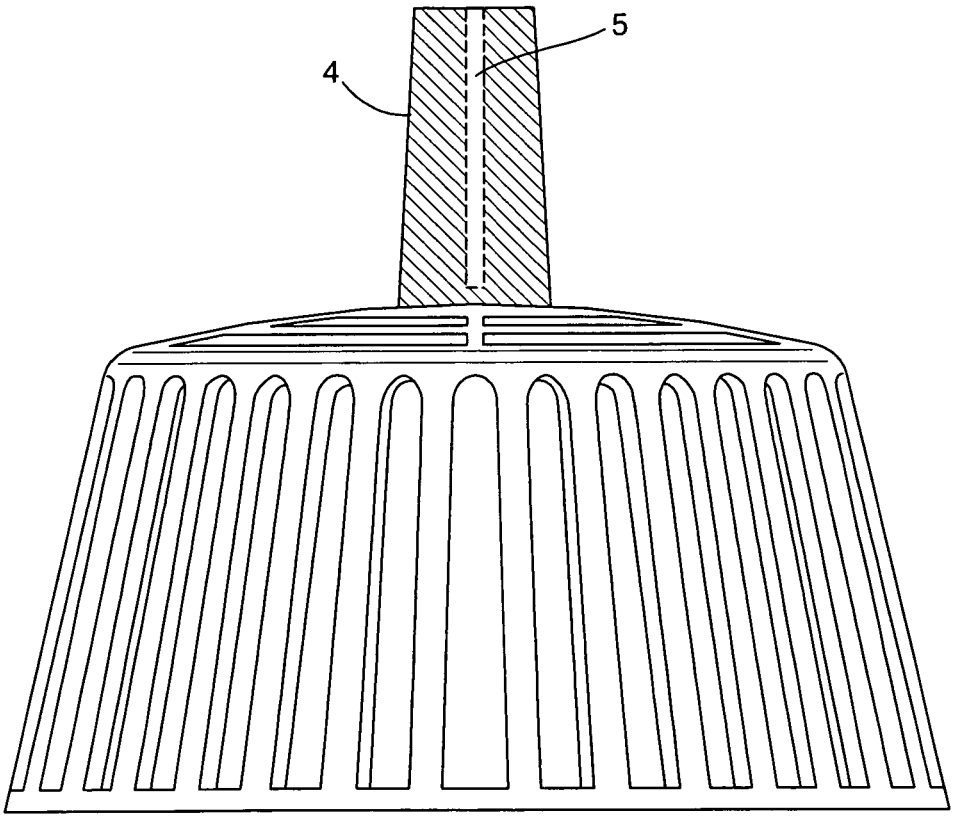
FIG. 4 is a cross-section view of the novel roof-drain cover of the embodiment of FIG. 1 showing the cavity. This view shows a novel roof-drain cover in condition for shipping.

Drain-cover 3 is a one-piece ribbed dome structure made of metal, plastic or other materials such as are commonly used in prior art roof-drain covers. Roof-drain cover 3 defines drain apertures and coupler means. Coupler means, shown as boss 4 in FIG. 1, mounts flag 2 on top of roof-drain cover 3. Boss 4, as an integral part of roof-drain cover 3, defines cavity 5, as indicated in FIGS. 2 and 4. Cavity 5 is sized to accept a base portion of flag 2.

Figure 3:
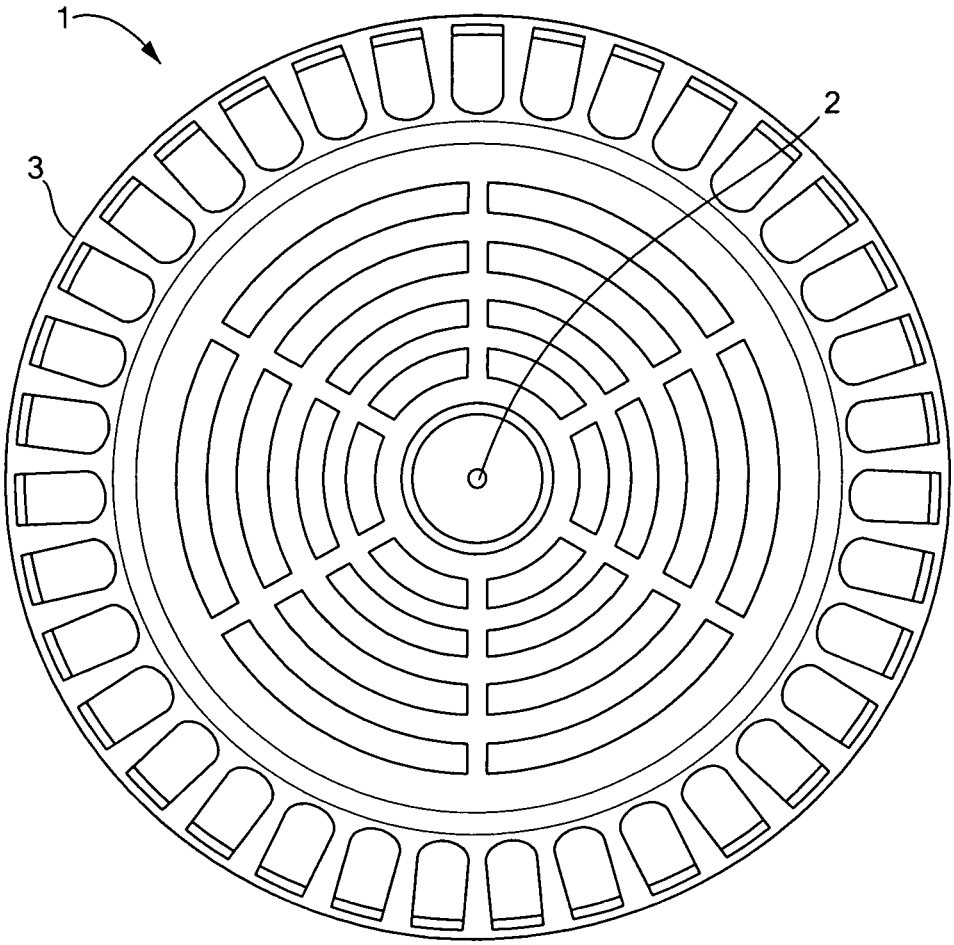
FIG. 3 is a top view of the embodiment of FIG. 1, showing the top and side apertures of the roof-drain cover.

FIG. 3 shows the top and side apertures of roof-drain cover 3.

A high-visibility roof-drain cover may be made and shipped as a one-piece roof-drain cover with flag. However, a one-piece high-visibility roof-drain cover as shown in FIG. 1, has an ungainly shape, making it an awkward item to ship. So it is expected that a roof-drain cover and a flag will be shipped to a building site as separate parts. FIG. 4 shows the novel roof-drain cover in condition for shipping to a building site, separately from its flag, for on-site assembly.

Referring again to FIG. 1, flag 2 defines a first flag end and a second flag end. It can be seen from FIG. 1 that when the first flag end is mounted to roof-drain cover 3 via boss 4, the second flag end is up. And when the second flag end is mounted to roof-drain cover 3 via boss 4, the first flag end is up. At least one of the flag ends is visibly marked, such that "first flag end up" is visibly distinguishable over "second flag end up". So reversing the vertical orientation of the flag, following an inspection of the roof-drain-cover, provides a visual indication that an inspection has been completed.

Figure 5:
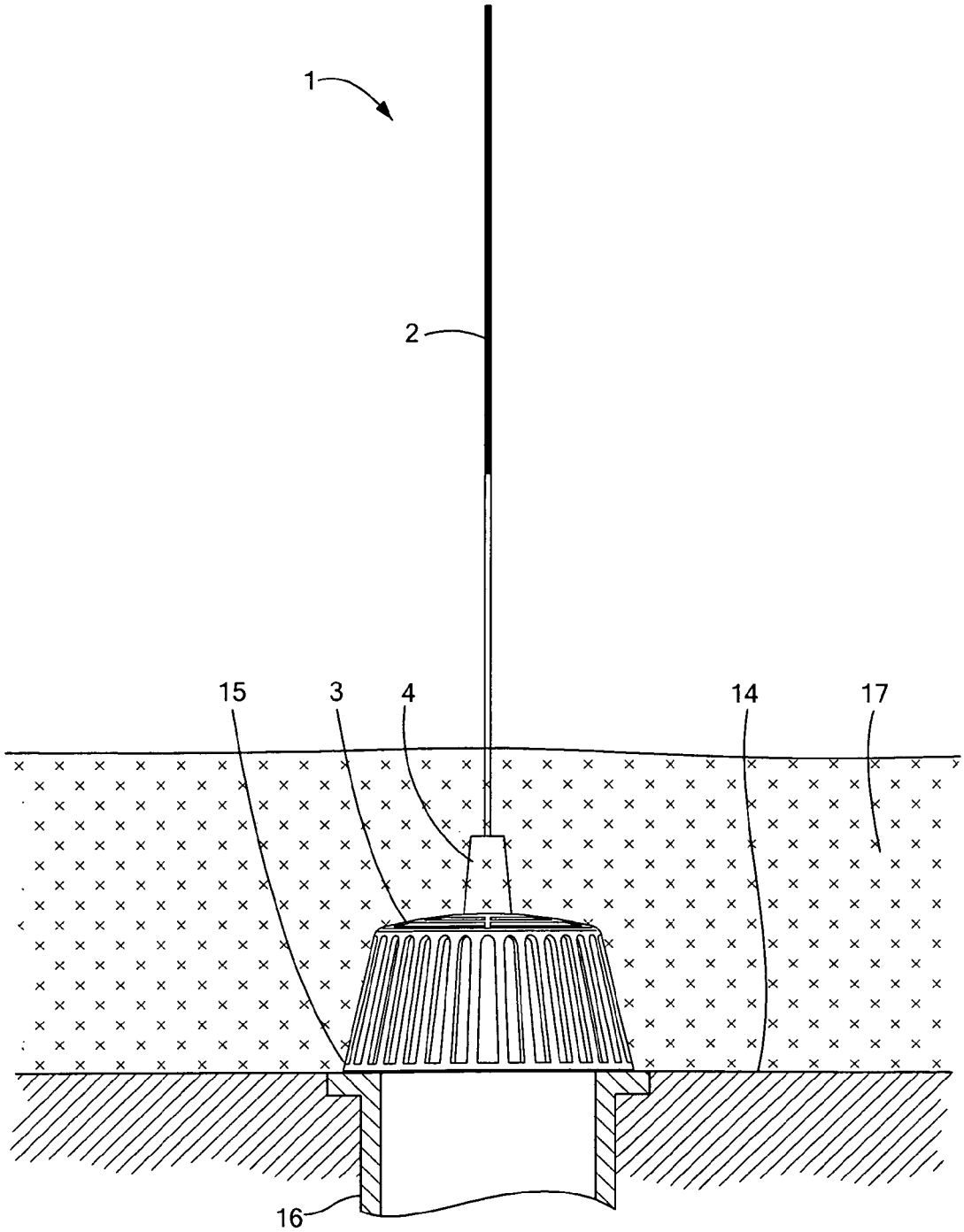
FIG. 5 is a front view of the embodiment of FIG. 1, with a top portion of the flag visible above a thick layer of snow. The flag has a lower end that is white and an upper end marked black.

FIG. 5 is a front view of the first preferred embodiment of the high-visibility roof-drain cover of FIG. 1. Roof-drain cover 3 is shown sitting on roof top 14. Roof-drain cover rim 15 is shown covering roof-drain 16.

FIG. 5 also shows the black first flag end portion of flag 2 up and fully visible above the thick layer of snow 17, and the white second flag end portion of flag 2 down and partially visible above the thick layer of snow 17.

In FIG. 5, flag 2 is shown having a lower end that is white and an upper end that is marked black. The upper and lower ends of flag 2 may be differently colored and/or differently patterned in any combination provided that "first flag end up" is visibly distinguishable over "second flag end up", so that reversing the vertical orientation of the flag, after an inspection of the roof-drain-cover, may provide a visual indication that an inspection has been performed.

Figure 6A:
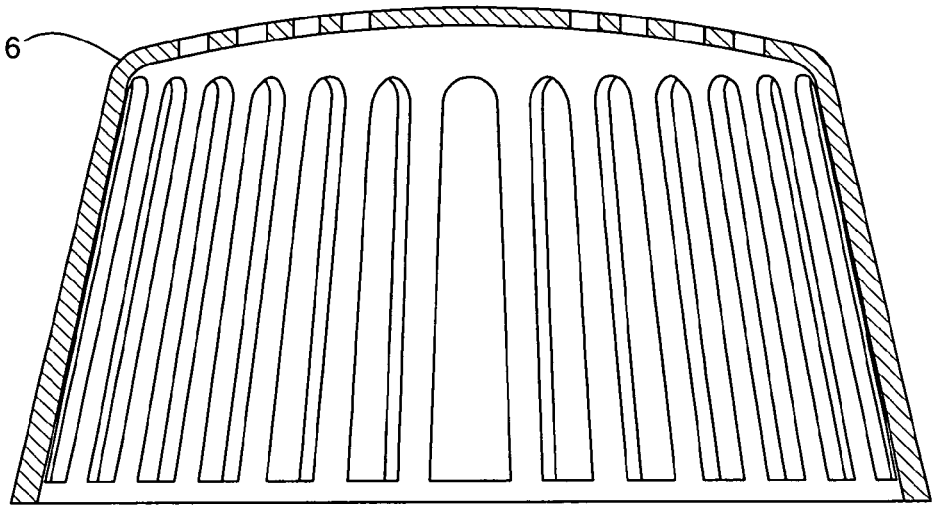
FIG. 6A PRIOR ART
FIG. 6A and FIG. 6B show a front view and a top view, respectively, of a prior art roof-drain cover that shows no means for mounting a flag on a roof-drain cover.
Figure 6B:
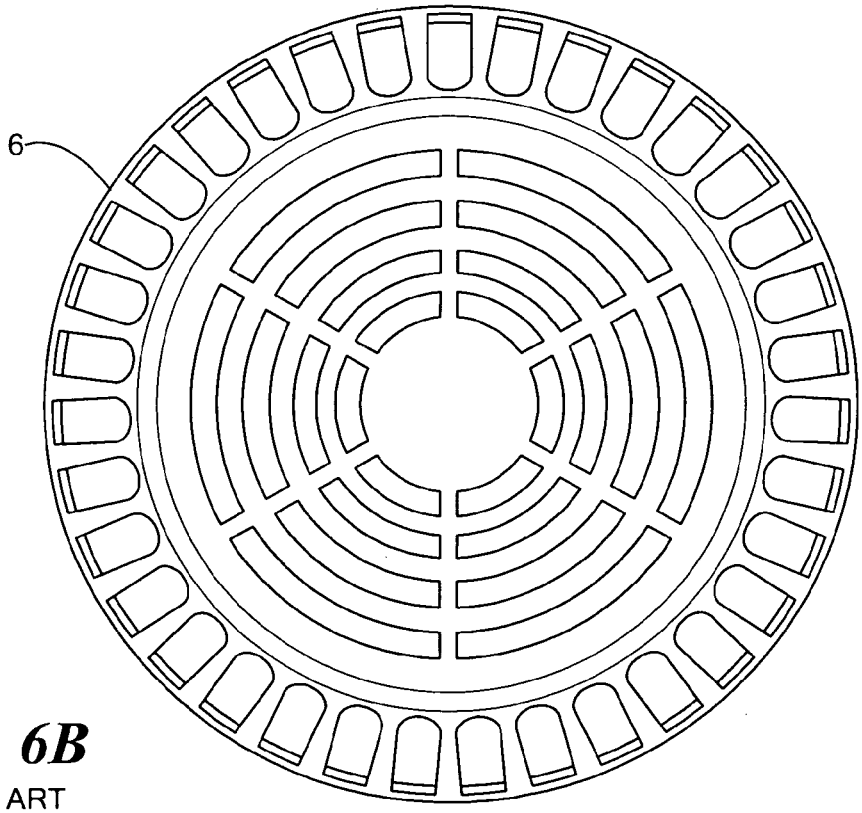
FIG. 6B PRIOR ART
Figure 7:
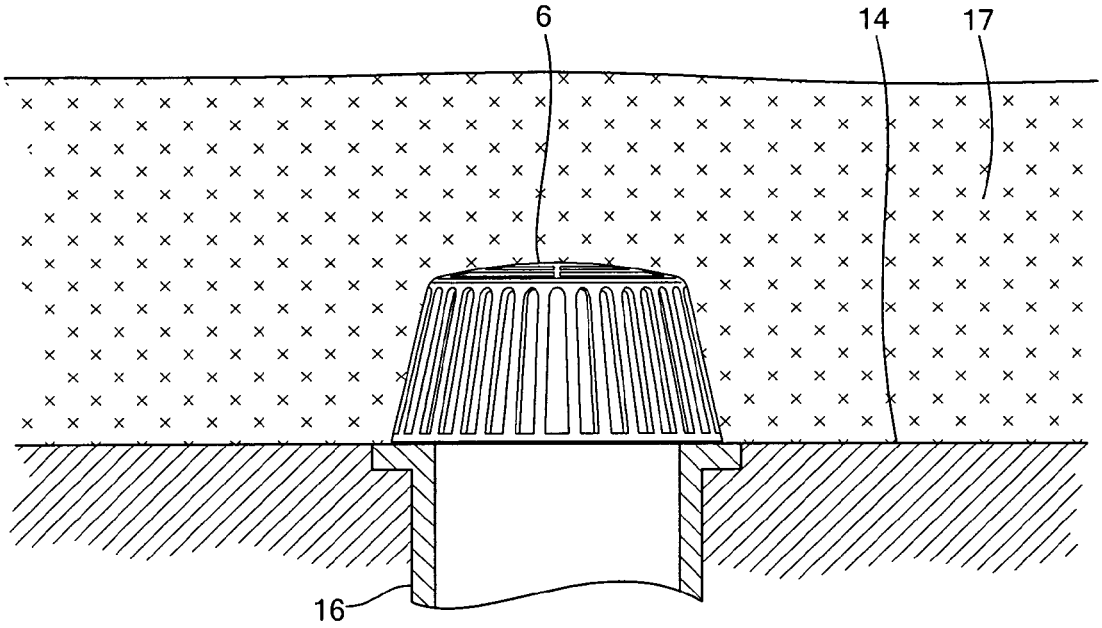
FIG. 7 PRIOR ART
FIG. 7 shows a front view of a prior art roof-drain cover buried under a under a thick layer of snow, where it would be completely hidden from view.

In contrast, FIG. 6A and FIG. 6B (prior art) show a front view and a top view, respectively, of prior-art roof-drain cover 6 that shows no means for mounting a flag on a roof-drain cover, and FIG. 7 (prior art) shows the front view of the prior-art roof-drain cover 6 buried under a under a thick layer of snow, where it is completely hidden from view.

Alternative Embodiments

Figure 8B:
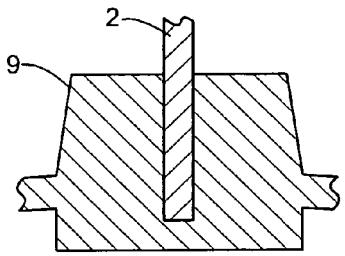
FIG. 8B is a cross-section front view of another alternative to the embodiment of FIG. 8A having a push-fit flag.
Figure 8C:
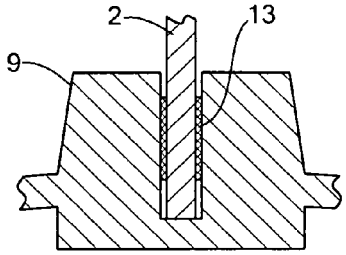
FIG. 8C is a cross-section front view of another alternative to the embodiment of FIG. 8A having a flag secured by adhesive.
Figure 8E:
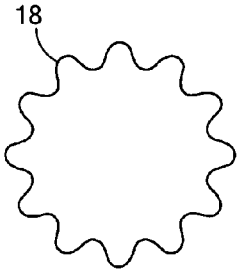
FIG. 8E is a top view of a corrugated-shell radial locking-spring.
Figure 8D:
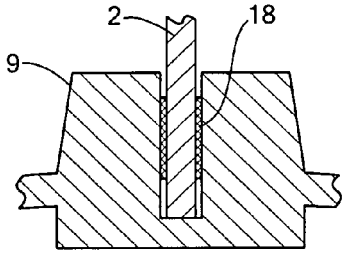
FIG. 8D is a cross-section front view of another alternative to the embodiment of FIG. 8A having a flag secured by a corrugated-shell radial locking-spring.
Figure 8A:
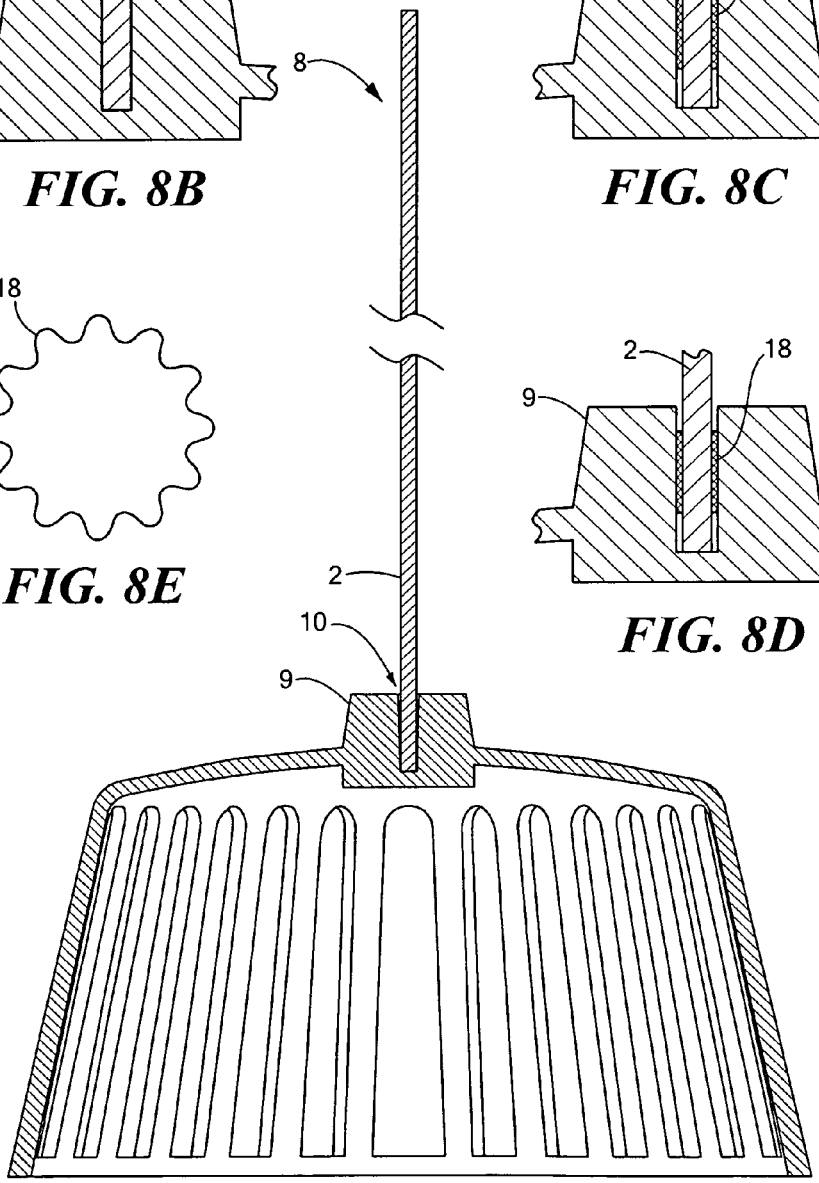
FIG. 8A is a cross-section front view of a one alternative to the embodiment of FIG. 1 having a short centered boss.

FIGS. 8A and 8B show an embodiment having a short boss 9 defining a short cavity, wherein the flag is secured in the cavity by push-fit.

FIG. 8C shows the flag secured in the cavity by adhesive 13.

FIG. 8D shows the flag secured in the cavity by a corrugated-shell radial locking-spring 18. Corrugated-shell radial locking-spring 18 is illustrated in plan view in FIG. 8E.

In another alternative embodiment (not shown), the base of the flag is secured within the cavity by a locking screw that is screwed through a threaded pilot hole in a wall surrounding the cavity such that the base of the flag may be locked in place.

Figure 9:
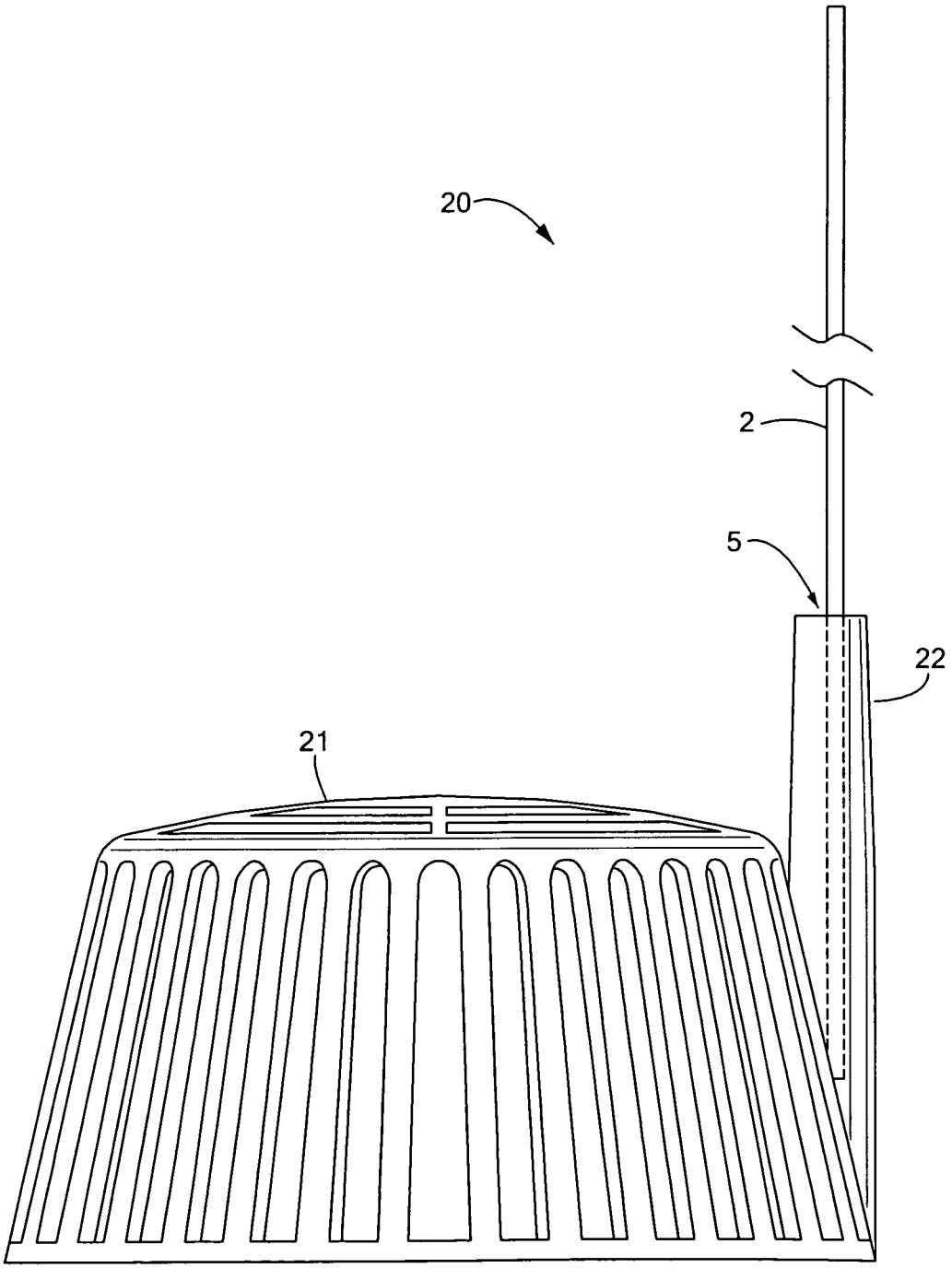
FIG. 9 is a front view of another alternative to the embodiment of FIG. 1. The high-visibility roof-drain cover includes a flag and a novel roof-drain cover that defines an elongated side-mounted boss.
Figure 10:
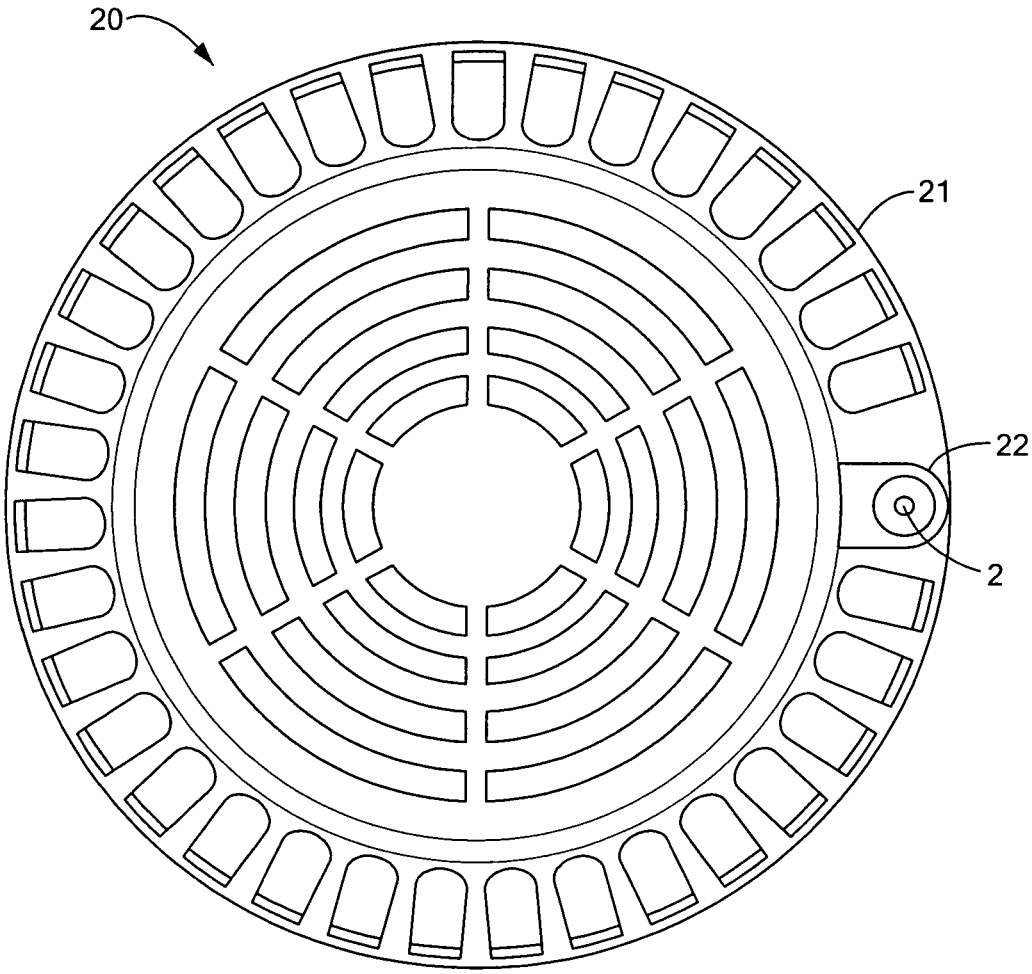
FIG. 10 shows a top view of the embodiment to of FIG. 9.
Figure 11:
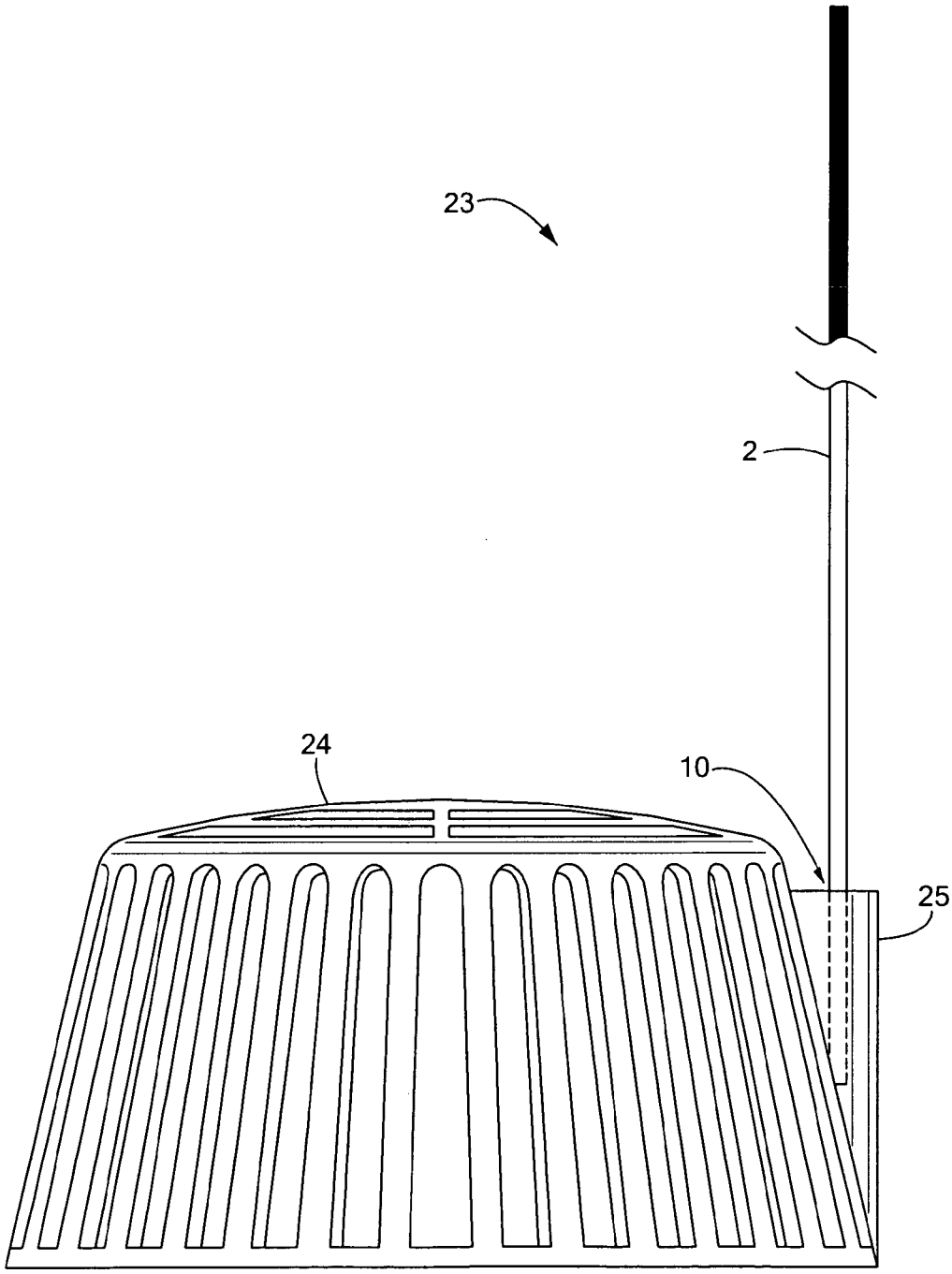
FIG. 11 is a front view of another alternative to the embodiment of FIG. 1. The high-visibility roof-drain cover includes a flag and a novel roof-drain cover that defines a short side-mounted boss.

FIGS. 9-11 show two other embodiments in which the boss is a shoulder boss located proximate to one side of the novel roof-drain cover. FIG. 9 shows an embodiment 20 having novel roof-drain cover 21 defining shoulder boss 22, with shoulder boss 22 rising to a height that is greater than the height of the roof-drain cover. FIG. 10 is a top view of the embodiment of FIG. 9. FIG. 11 shows an embodiment 23 having novel roof-drain cover 24 defining shoulder boss 25, with shoulder boss 25 rising to a height that is less than the height of the roof-drain cover.

Preferred Retrofit Embodiment

Figure 12:
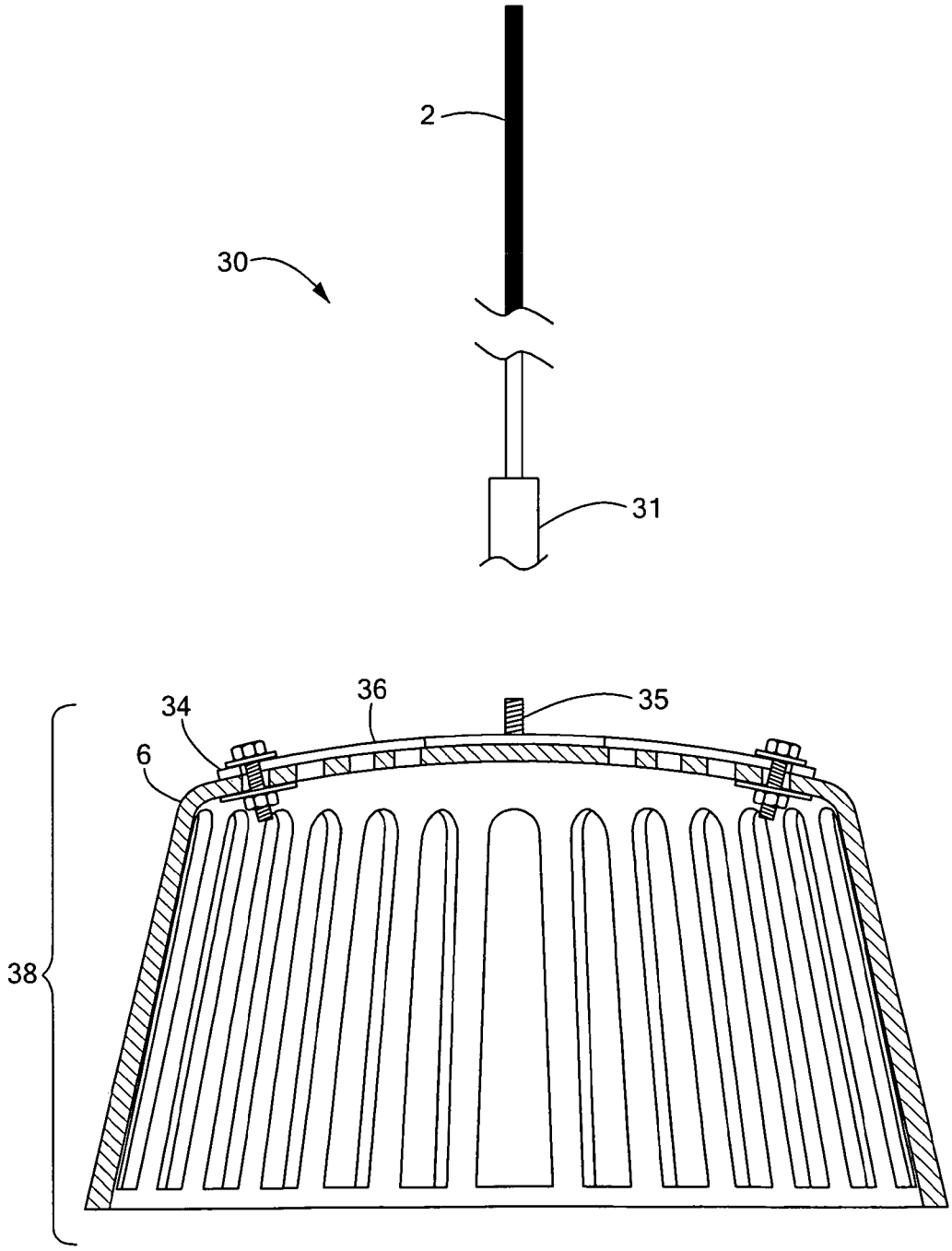
FIG. 12 is a front view of a second preferred embodiment of a high-visibility roof-drain cover comprising a prior art roof-drain cover and attachment parts for converting a prior art roof-drain cover into a high-visibility roof-drain cover.
Figure 13:
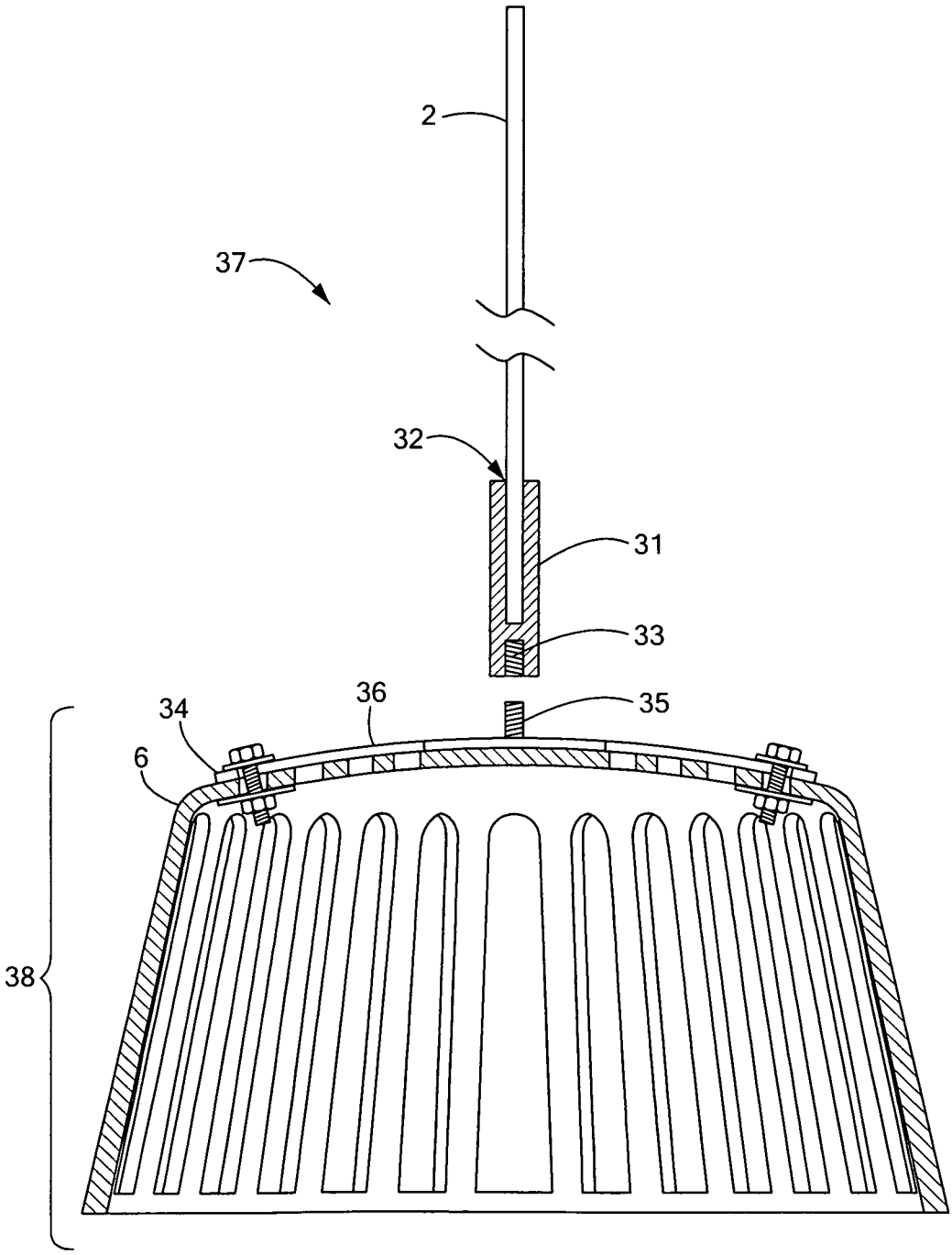
FIG. 13 shows the two shipping parts of one version of embodiment of FIG. 12. The first shipping part is a flag subassembly comprising a flag attached to a flag coupler. The second shipping part is a prior art roof-drain cover having an attached coupler strip that defines a threaded stub.
Figure 14:
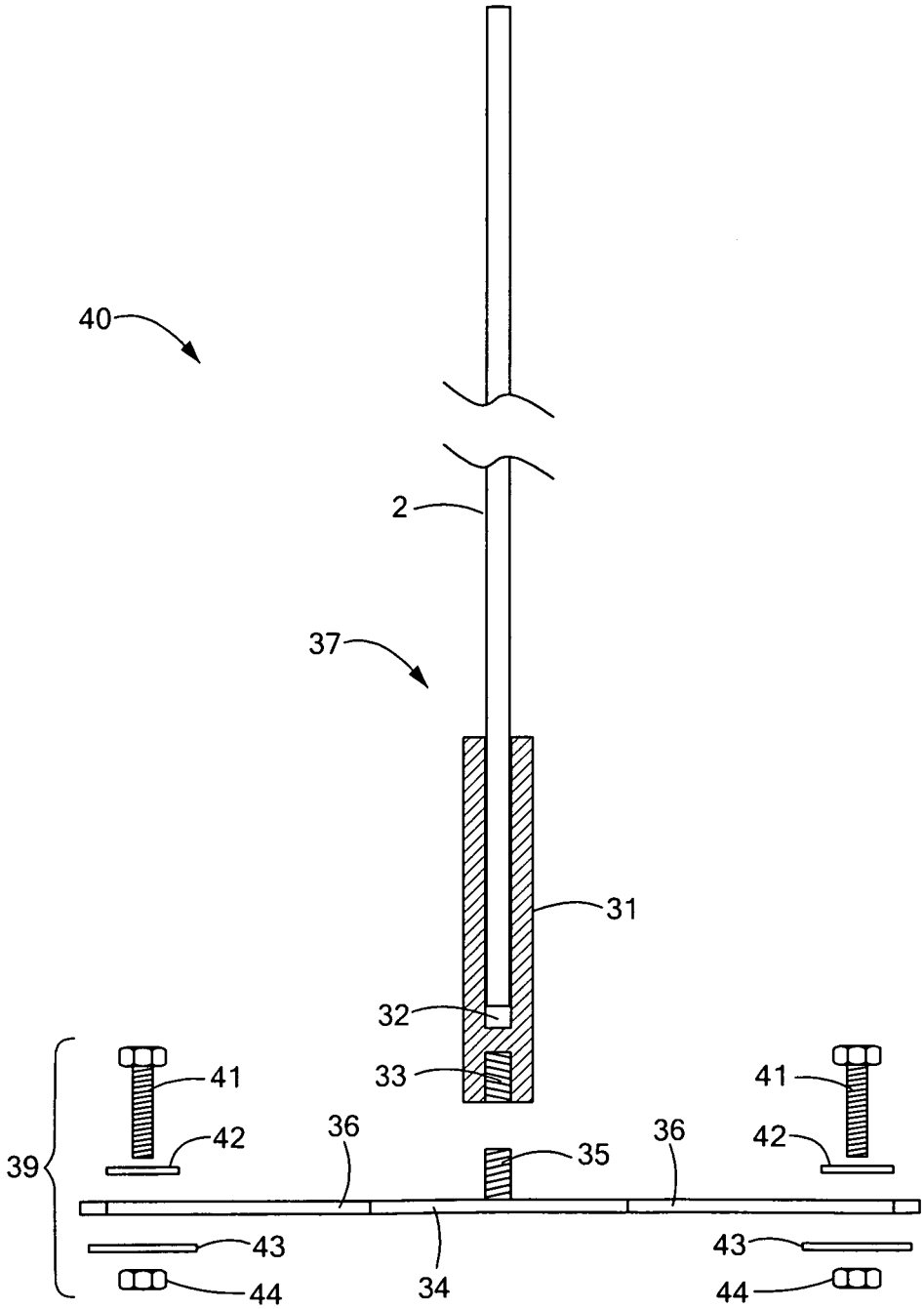
FIG. 14 shows the piece-parts used in the embodiment of FIG. 12.

A preferred retrofit embodiment of the invention is shown in FIGS. 12-14.

FIG. 12 shows the preferred retrofit embodiment, high-visibility roof-drain cover 30. The preferred retrofit embodiment includes a prior art roof-drain cover 6, a marked flag 2, and coupler means. The coupler means includes elongated flag coupler 31, coupler strip 34 with centrally-located threaded stub 35, and mounting hardware for mounting the coupler means to the prior art roof-drain cover. Coupler strip 35 preferably defines two elongated apertures 36 sized to accept the hardware fasteners used to attach coupler strip 35 to prior art roof-drain cover 6.

The subassemblies and piece parts of the preferred retrofit embodiment are shown in FIGS. 13 and 14.

FIG. 13 shows elongated flag coupler 31 defining first cavity 32 at a top end of the flag coupler, and threaded cavity 33 at a bottom end of the flag coupler. Top cavity 32 is sized to hold a base portion of flag 2 therein. Threaded stub 36 is adapted to couple with threaded cavity 33.

FIG. 13 shows flag coupler subassembly 37 as flag 2 attached to flag coupler 31. FIG. 13 also shows roof-drain cover subassembly 38 consisting of elongated coupler strip 34 attached to prior art roof-drain cover 6. Coupler strip 34 defines centrally-located threaded stub 35.

Flag retrofit parts 40, associated with the second preferred embodiment of FIG. 12, are shown in FIG. 14 to include flag coupler subassembly 37 and piece parts 39. Piece parts 39 comprise coupler strip 34, bolts 41, small washers 42, large washers 43, and nuts 44.

This structure makes a flag coupler subassembly, having a marked, reversible, elongated flag, and a flag coupler having a first end and a second end, the first end defining a first cavity adapted for reversible mounting of a base portion of the flag the first cavity, the second end defining a threaded cavity sized to accept a threaded stub attached to an upper portion of a roof-drain cover.

The provision of compact subassemblies such as this supports low-cost shipping, and assembly for on-site retrofit of high-visibility roof-drain covers.

Alternative Retrofit Embodiments

Figure 15:
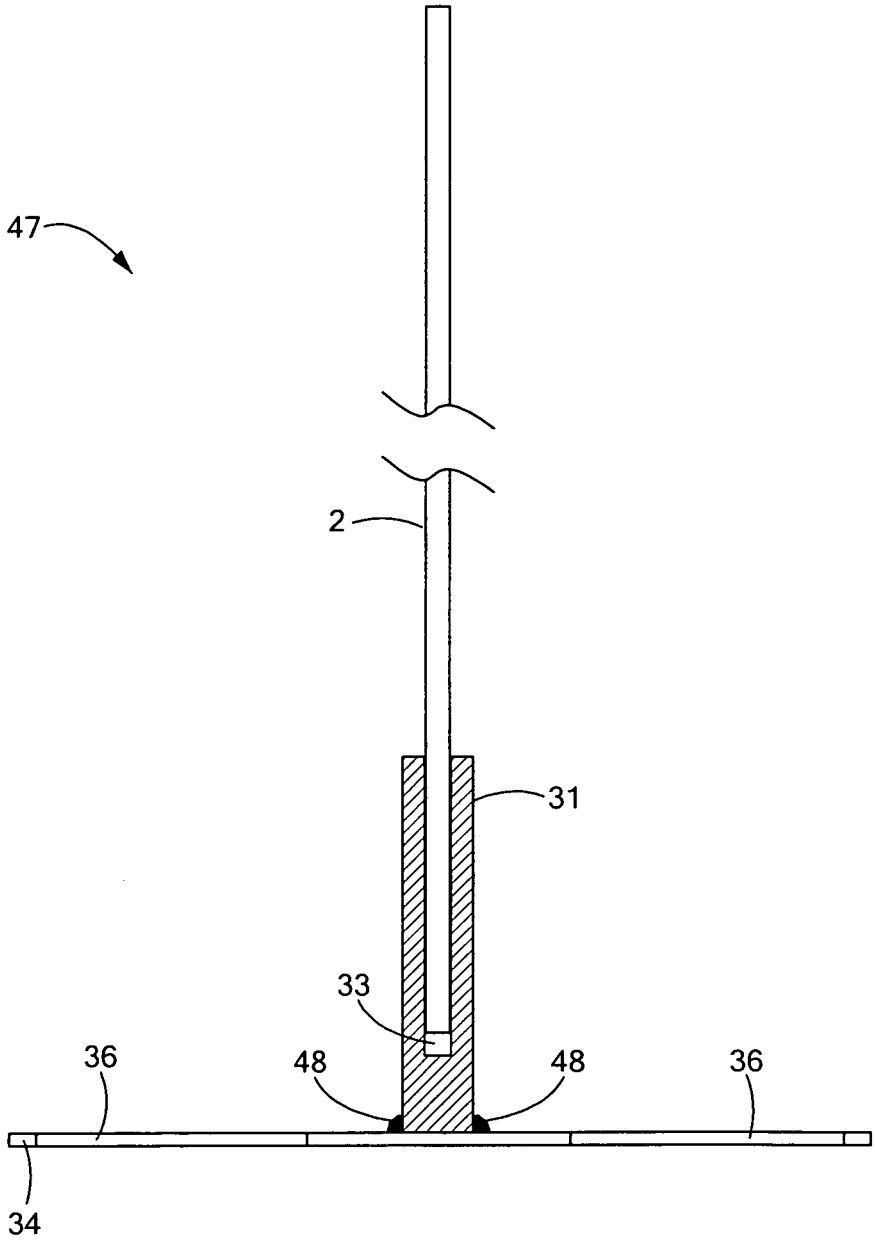
FIG. 15 shows the parts of an embodiment in which the flag coupler is attached to the coupler strip by a spot weld.

One alternative to the retrofit embodiment of FIGS. 12-14 is shown in FIG. 15. FIG. 15 shows this retrofit embodiment as having coupler strip 34 attached to flag coupler 31 by spot weld 48 to form flag coupler subassembly 47. Flag 2 and the welded assembly may be shipped separately for assembly on site.

Figure 16A:
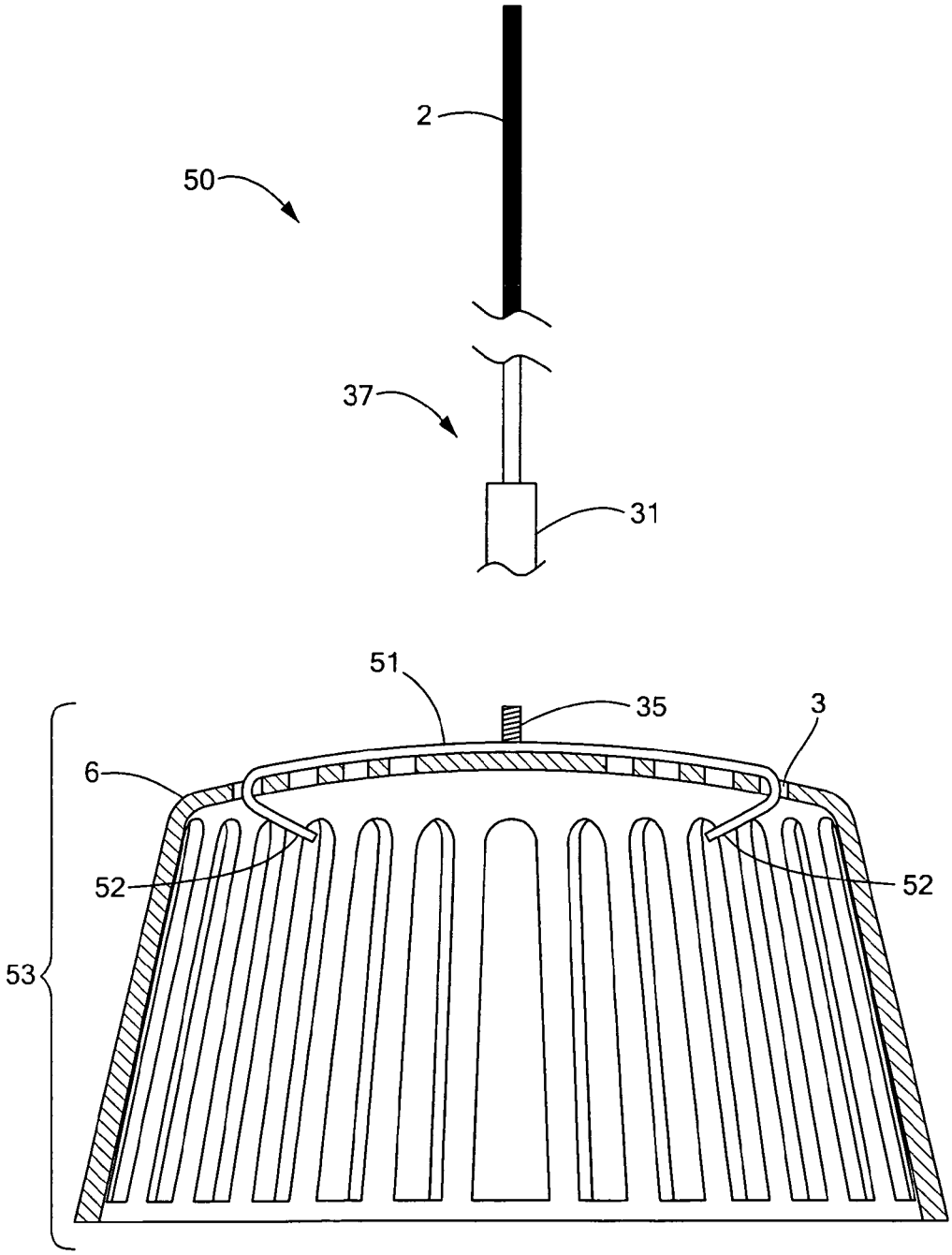
FIG. 16A is a front view of an embodiment having an elongated spring-tab coupler strip with spring-tab ends passing through the top apertures of a roof-drain cover.

Another alternative to the embodiment of FIGS. 12-14, retrofit high-visibility roof-drain cover 50, is shown in FIGS. 16A-16C.

FIGS. 16A and 16B show high-visibility roof-drain cover 50 consisting of flag coupler subassembly 37 and roof-drain cover subassembly 53. FIG. 16A also shows spring-tab coupler strip 51 defining a threaded stub 35. However, in contrast to the embodiment of FIGS. 12-14, spring-tab coupler strip 51 is an elongated strip that defines spring-tab ends 52.

FIGS. 16A and 16B also show roof-drain cover subassembly 53 consisting of spring-tab coupler strip 51 and prior art roof-drain cover 6. Spring-tab coupler strip 51 is attached to prior art roof-drain cover 6 by spring-tab ends 52 passing through top apertures in the roof-drain cover.

FIG. 16C is a top view of the embodiment of FIG. 16A.

Figure 17A:
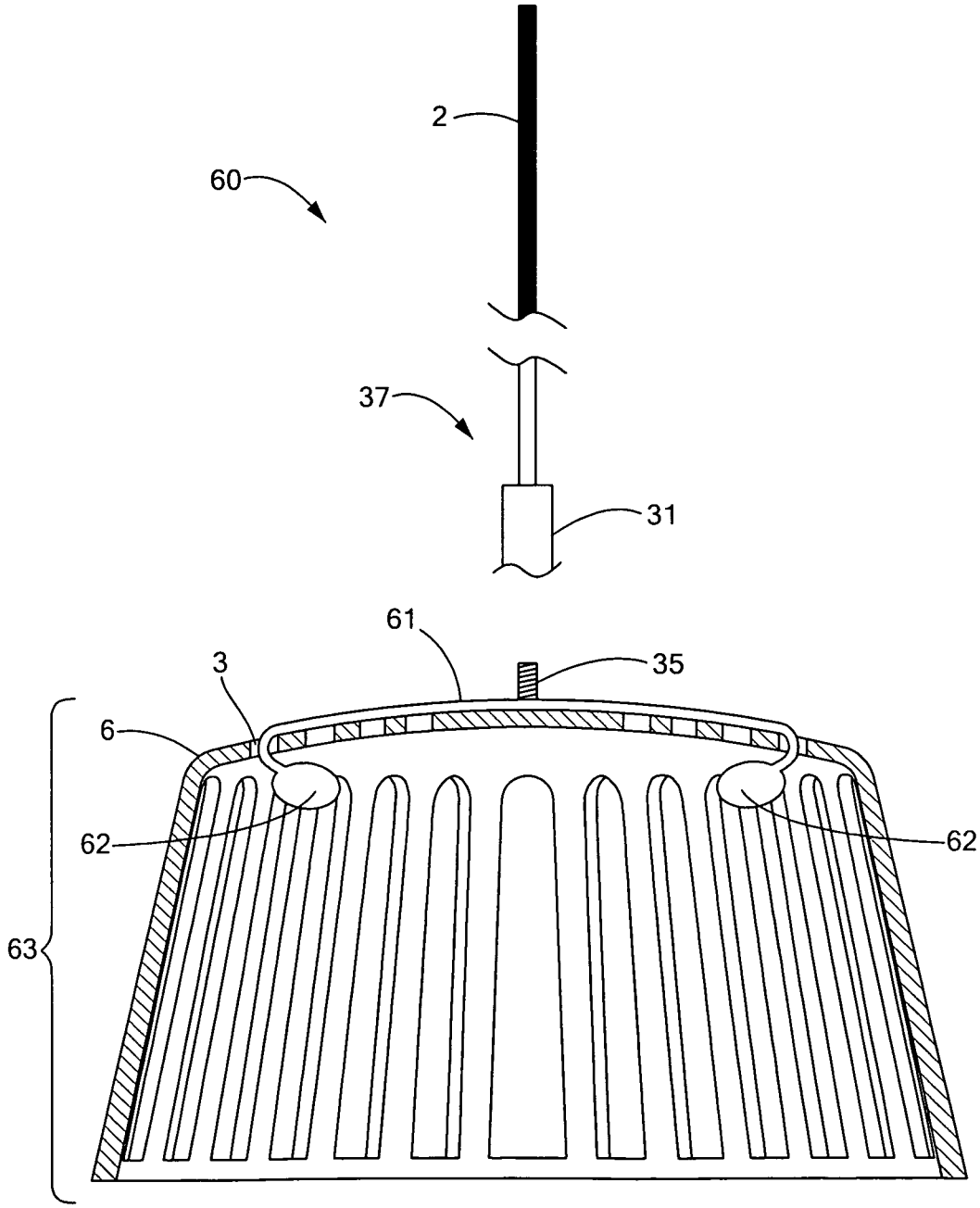
FIG. 17A is a front view of an alternative to the embodiment of FIG. 16A having an elongated twist-tab coupler strip with twist-tab ends.
Figure 17C:
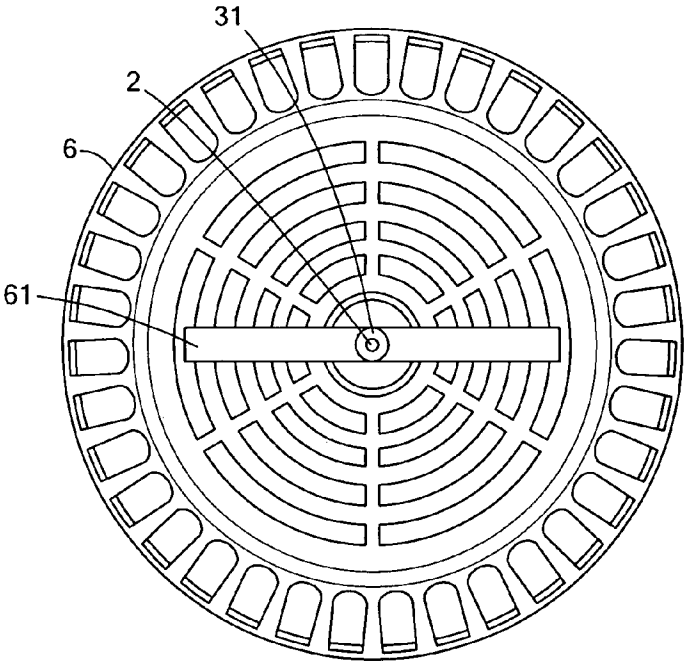
FIG. 17C is a top view of the embodiment of FIG. 17A.
Figure 17B:
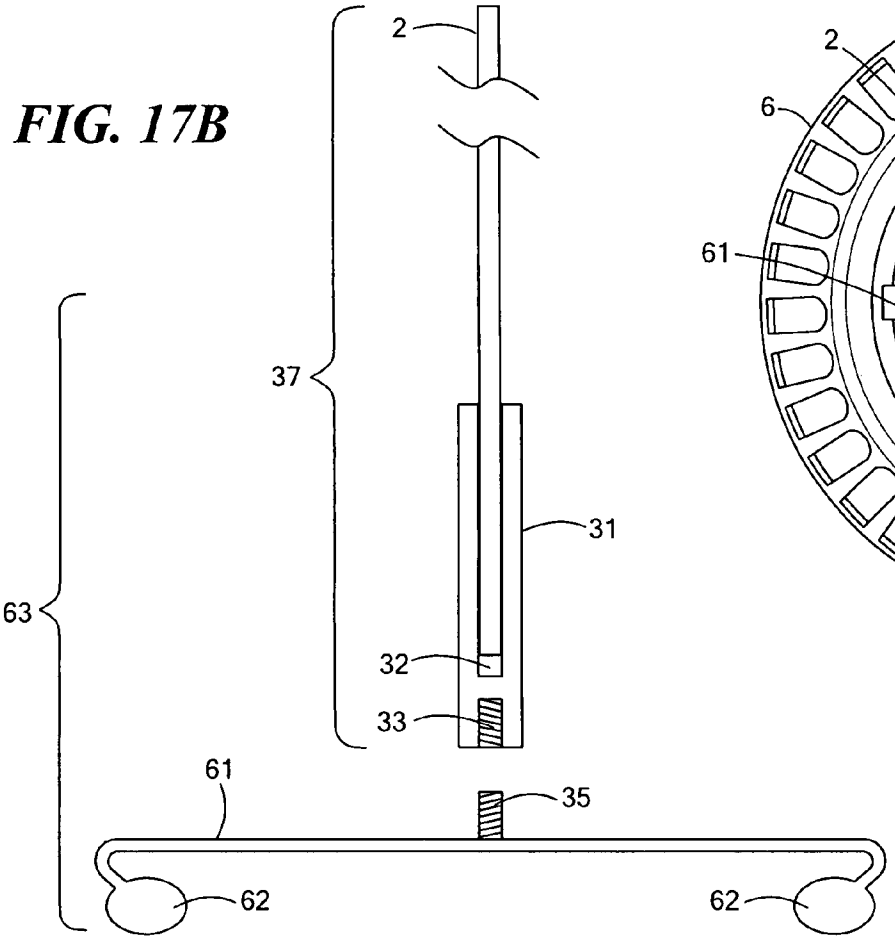
FIG. 17B shows the attachment parts of the embodiment of FIG. 17A.

Another alternative to the embodiment of FIGS. 12-14, retrofit high-visibility roof-drain cover 55, is shown in FIGS. 17A-17C.

FIGS. 17A and 17B show high-visibility roof-drain cover 60 consisting of flag coupler subassembly 37 and roof-drain cover subassembly 63. FIG. 17A also shows twist-tab coupler strip 61 defining a threaded stub 35. However, in contrast to the embodiment of FIGS. 12-14, twist-tab coupler strip 61 is an elongated strip that defines twist-tab ends 62.

FIGS. 17A and 17B also show roof-drain cover subassembly 63 consisting of twist-tab coupler strip 61 and prior art roof-drain cover 6. Spring-tab coupler strip 61 is attached to prior art roof-drain cover 6 by twist-tab ends 62 passing through top apertures in the roof-drain cover, and twist-tab ends 62 twisted.

FIG. 17C is a top view of the embodiment of FIG. 17A.

Figure 18A:
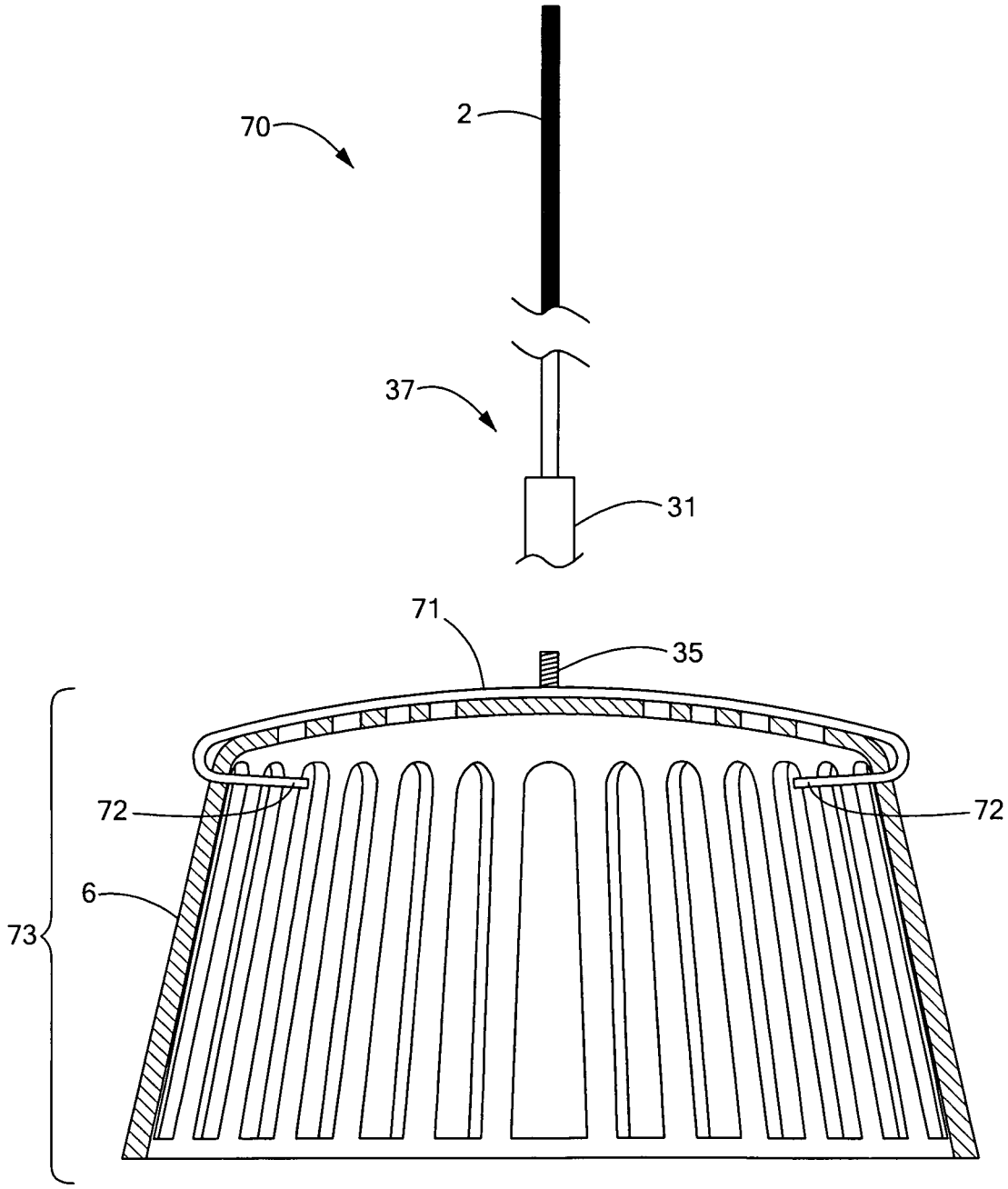
FIG. 18A is a front view of another alternative to the embodiment of FIG. 16A having an elongated tab coupler strip with tab ends passing through side apertures in the roof-drain cover.
Figure 18C:
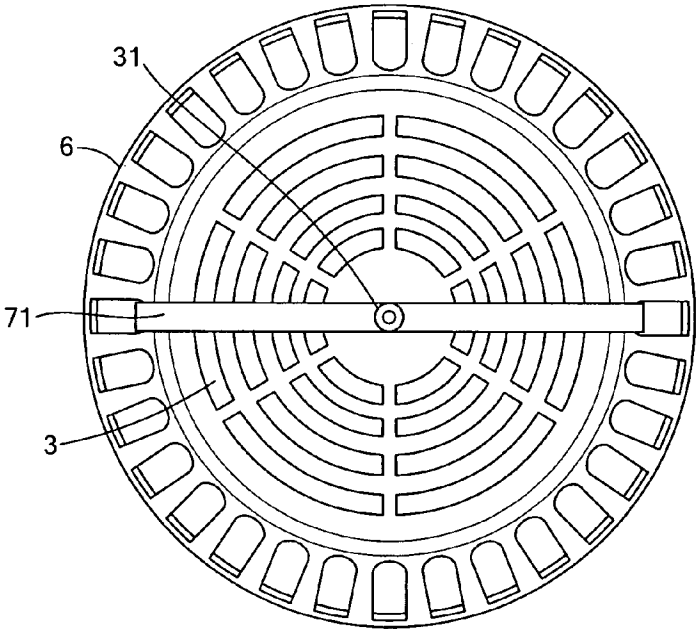
FIG. 18C is a top view of the embodiment of FIG. 18A.
Figure 18B:
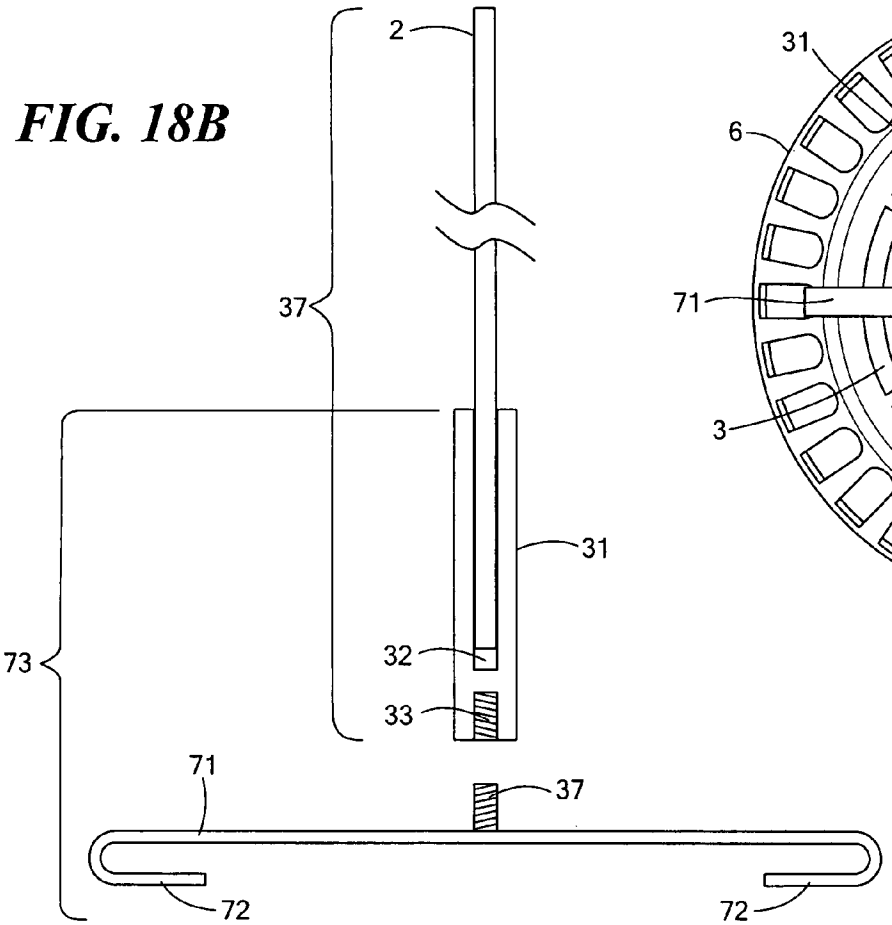
FIG. 18B shows the attachment parts of the embodiment of FIG. 18A.

Another alternative to the embodiment of FIGS. 12-14, retrofit high-visibility roof-drain cover 70, is shown in FIGS. 18A-18C.

FIGS. 18A and 18B show high-visibility roof-drain cover 70 consisting of flag coupler subassembly 37 and roof-drain cover subassembly 73. FIG. 18A also shows spring-tab coupler strip 71 defining a threaded stub 35. However, in contrast to the embodiments of FIGS. 12-14 and FIGS. 16A-16C, spring-tab coupler strip 71 is an elongated strip that is attached to prior art roof-drain cover 6 by spring-tab ends 72 passing through side apertures in the roof-drain cover.

FIGS. 18A and 18C show spring-tab coupler strip 71 is attached to prior art roof-drain cover 6 by spring-tab ends 72 passing through side apertures in the roof-drain cover.

FIG. 18C is a top view of the embodiment of FIG. 18A.

Figure 19A:
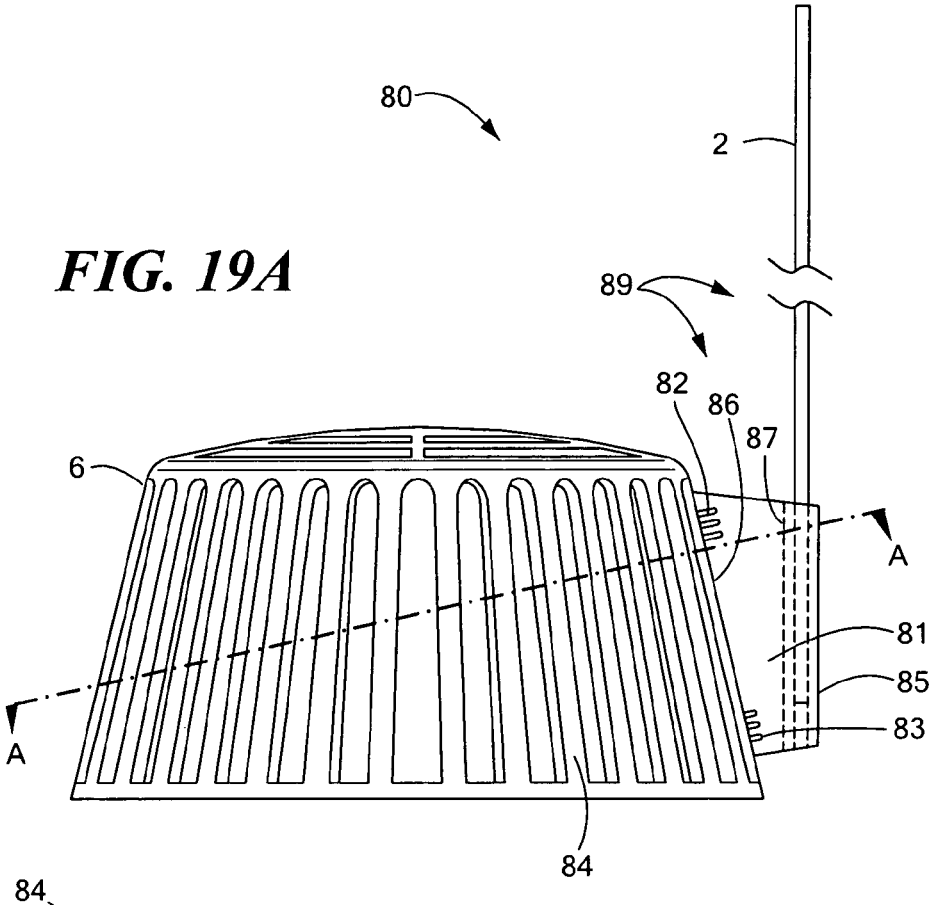
FIG. 19A is a front view of another alternative to the embodiment of FIG. 16A having a coupler plate, and rib-clasps having rib fingers for gripping a rib of the roof-drain cover.
Figure 19B:
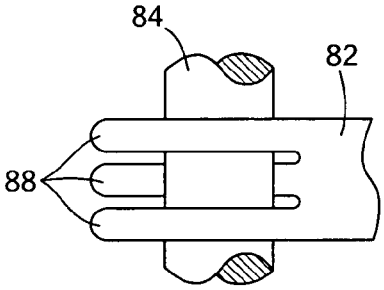
FIG. 19B is a partial side view of the embodiment of FIG. 19A, showing rib fingers gripping a rib.
Figure 19C:
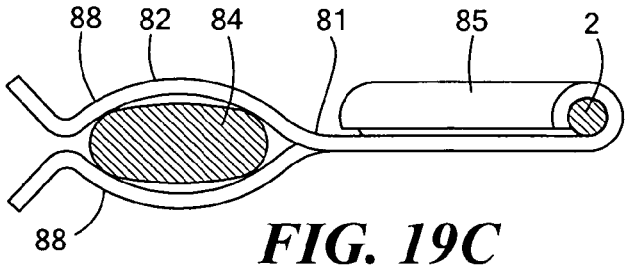
FIG. 19C is a partial cross-section view of the embodiment of FIG. 19A, showing rib fingers gripping a rib, and also showing a top view of a roll-up flag-grip gripping the flag.

Another alternative to the embodiment is shown in FIGS. 19A-19C as retrofit high-visibility roof-drain cover 80.

FIG. 19A shows roof-drain cover defining a grid having ribs and apertures between the ribs, and coupler means defined by a coupler plate 81 having a long rib-edge 86 and a long flag-edge 87. The long rib-edge defines an upper rib-clasp 82 and a lower rib-clasp 83. Long flag-edge 87 defines means for gripping the flag at flag-edge 87 of coupler plate 81.

Each rib-clasp is bent into an aperture between two ribs to grip the roof-drain cover edge.

Roll-up flag-grip 85 provides means for gripping flag 2.

Retrofit high-visibility roof-drain cover 80 includes coupling plate 81 which defines rib-clasps 82 and 83. Upper and lower rib-clasps 82 and 83, respectively, are inserted into an aperture between adjacent ribs 84 to attach coupler plate 81 to prior art roof-drain cover 6. Roll-up flag-grip 85 mounts flag 2 to coupler plate 81.

FIG. 19B is a partial side view of rib fingers 88 of upper spring rib-clasp 82 gripping one of ribs 84. FIG. 19C is a partial cross-section view of rib fingers gripping one of ribs 84, and showing a top view of roll-up flag-grip 85 gripping flag 2. FIG. 19A also shows flag coupler subassembly 89.

Figure 20A:
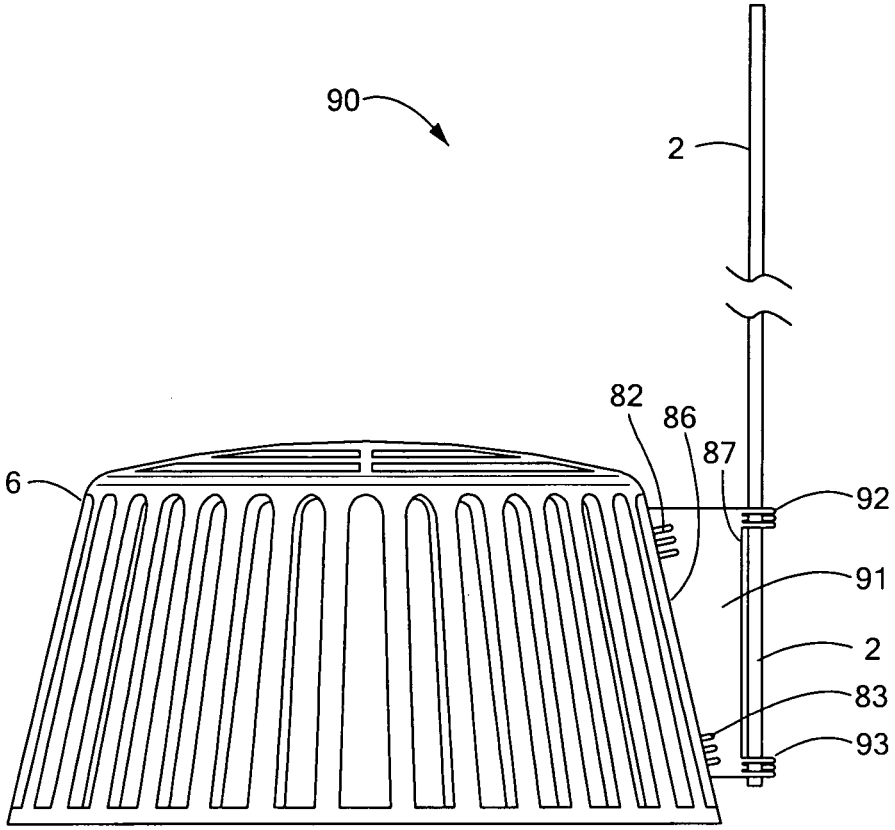
FIG. 20A is a front view of another alternative to the embodiment of FIG. 16A, showing a coupler plate with flag-clasps, each having with flag fingers gripping the flag.
Figure 20B:
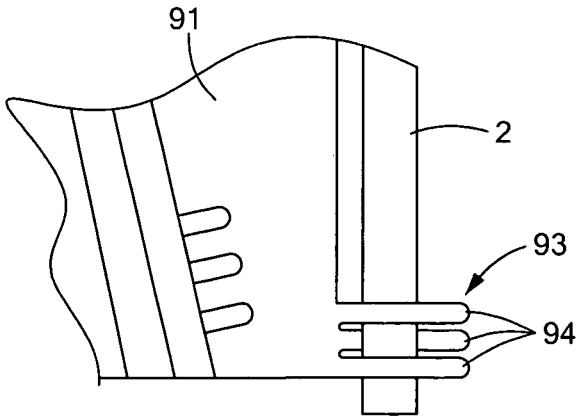
FIG. 20B shows detail of lower flag-clasp gripping a flag.

FIGS. 20A-20B show an alternative to the embodiment of FIGS. 19A-19C. In this embodiment, high-visibility roof-drain cover 90, the coupler means defines coupler plate 91 and the means for mounting the flag to the roof-drain cover, including upper flag-clasp 92 and lower flag-clasp 93. Long flag-edge 87 defines flag-clasps 92 and 93, each flag-clasp having fingers 94 for gripping the flag, and each flag-finger being bent to grip the flag. Preferably, each flag-clasp has at least three flag-fingers.

Figure 21A:
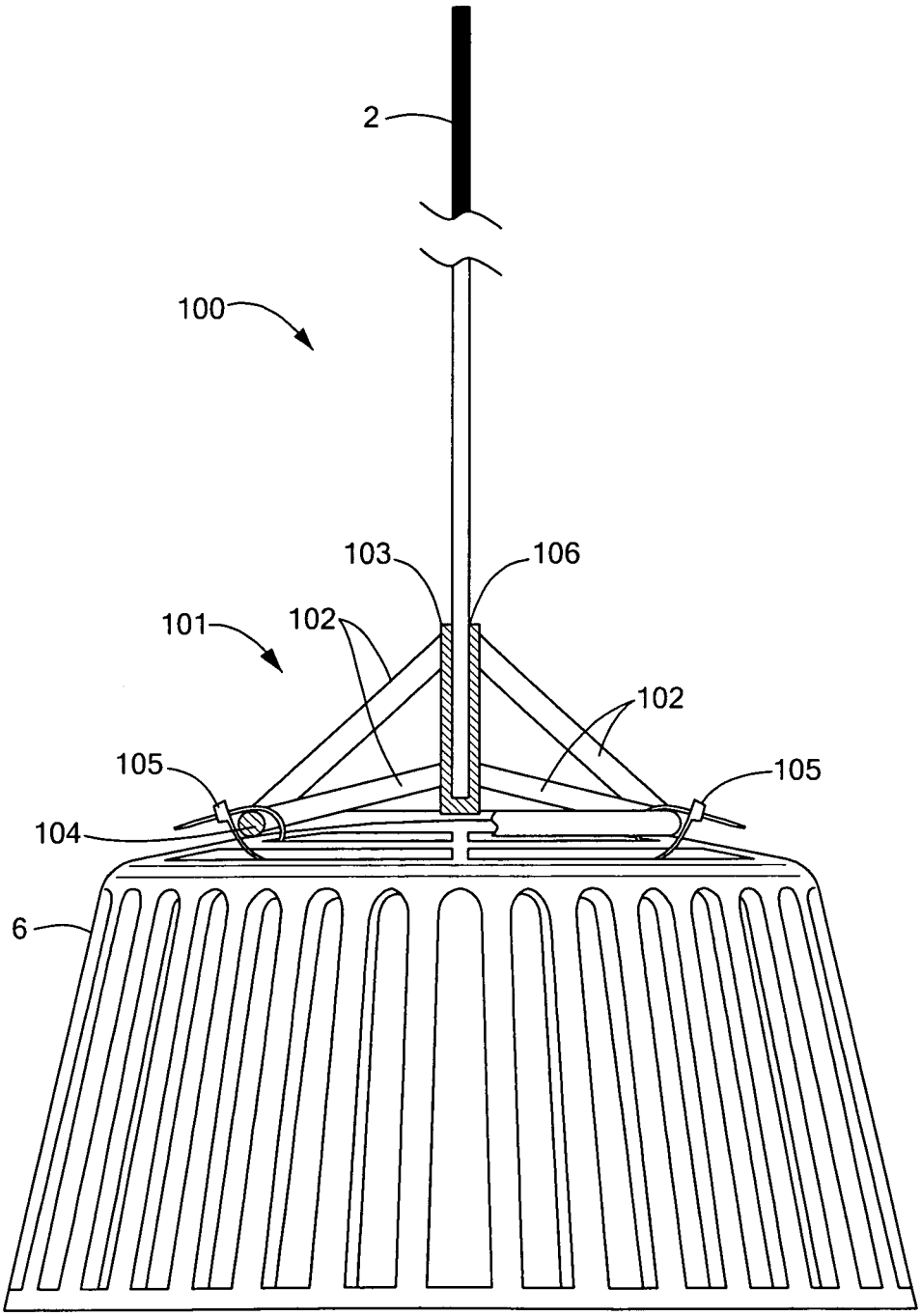
FIG. 21A shows another alternative embodiment having a flag coupler with struts and elongated boss defining a rigid structure that holds the flag. Two locking fasteners lock the flag coupler to the roof-drain cover.
Figure 21B:
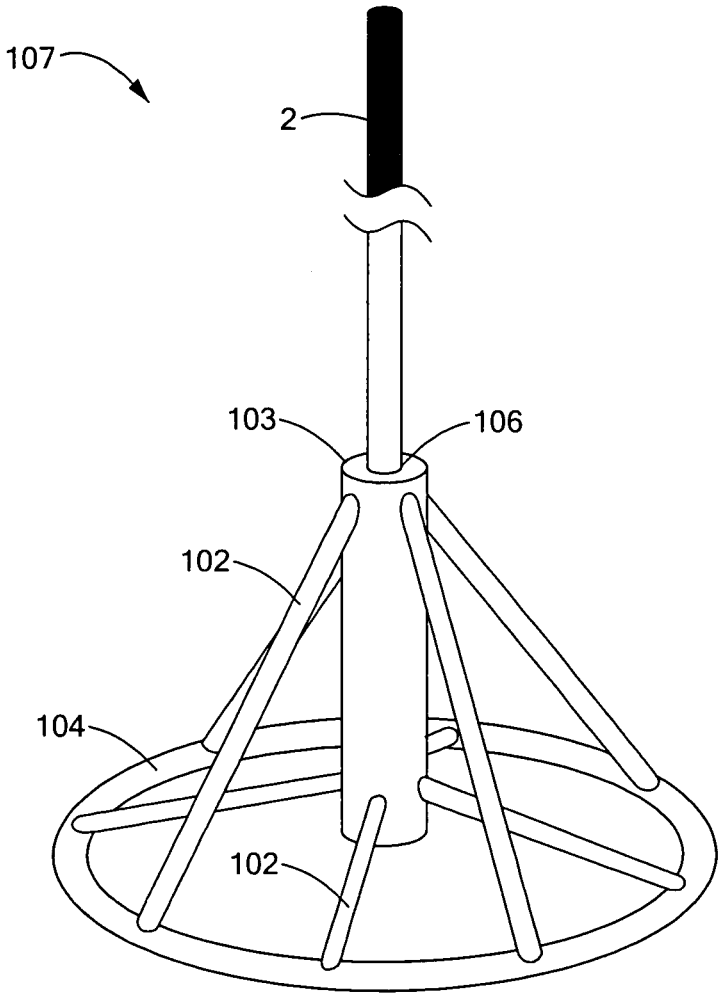
FIG. 21B is a perspective view of the flag coupler of the embodiment of FIG. 21A.

FIGS. 21A and 21B show another alternative to the embodiments of FIGS. 12-20A. In this embodiment, high-visibility roof-drain cover 100 includes flag coupler 101. In FIG. 21A, flag coupler 101 is formed as a rigid structure having a plurality of struts 102. Struts 102 support elongated boss 103. Elongated boss 103 defines elongated cavity 106 which is sized to accept a base portion of flag 2 therein. The rigid structure further includes peripheral rim 104 defining a base, as illustrated in FIGS. 21A and 21B. The base is shaped to be sufficiently concave that it provides a snug fit over the convex upper portion of the prior art roof-drain cover. Two locking fasteners 105 lock flag coupler 101 to roof-drain cover 100. FIG. 21B also shows flag-coupler subassembly 107.

Figure 22B:
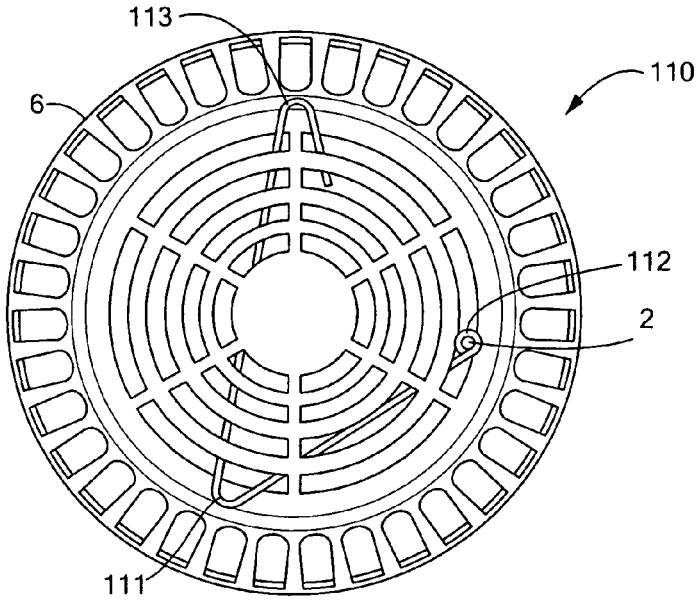
FIG. 22B is a top view of the embodiment of FIG. 22A.
Figure 22A:
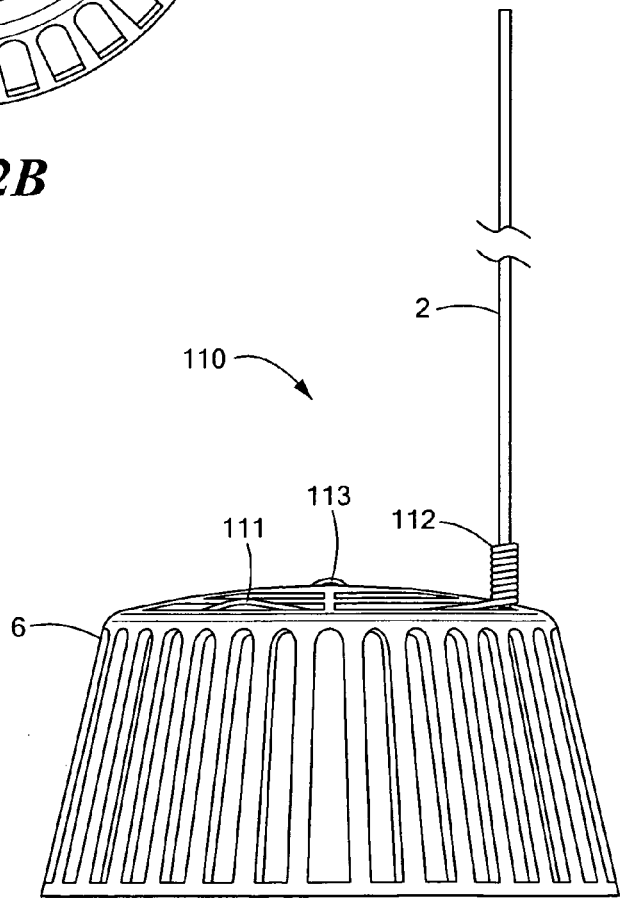
FIG. 22A is a front view of another alternative embodiment having a shaped-wire flag coupler. An upper portion is adapted to grip and support a base portion of a flag. A lower locking portion adapted to lock the flag-coupler to a surface of the roof-drain cover.

FIGS. 22A-22B show another alternative embodiment 110 in which the coupler means is a shaped-wire flag coupler that defines a locking portion 111 for locking the shaped-wire coupler to the roof-drain cover, and a coil-grip portion 112 for gripping a base portion of the flag such that the flag is held in a substantially vertical orientation.

Figure 23A:
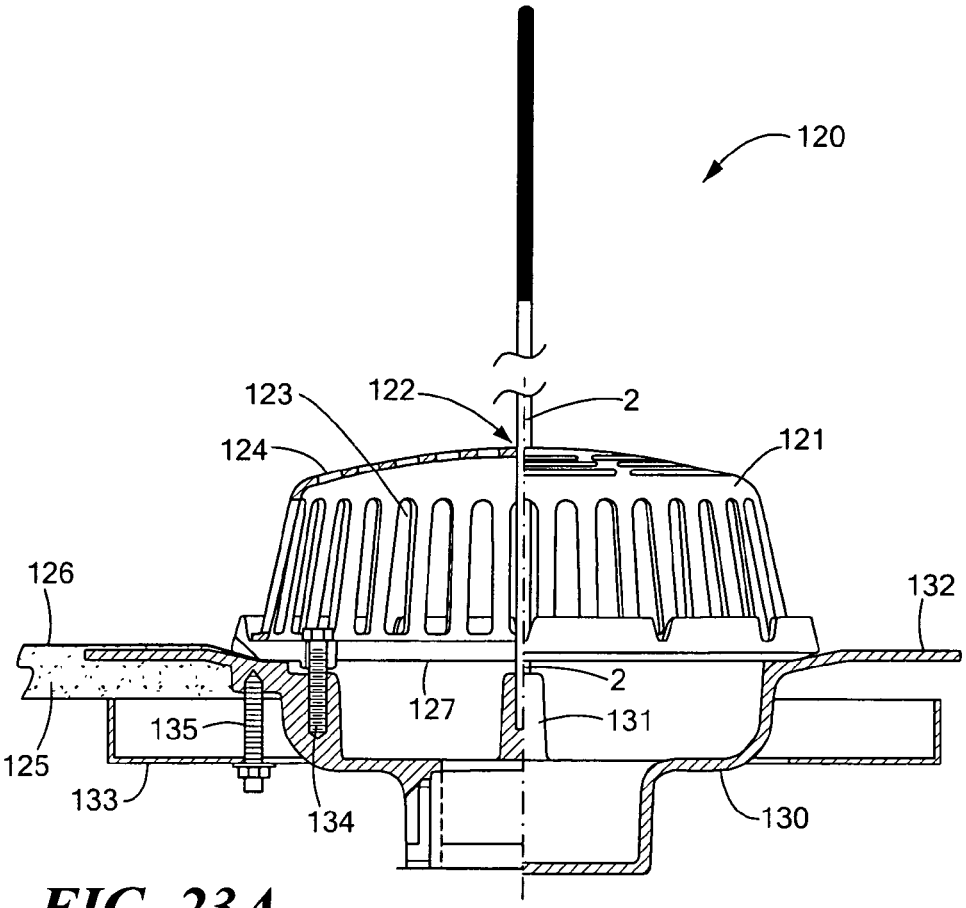
FIGS. 23A and 23B show another alternative embodiment 120 in which an elongated flag passes through a small central aperture in the roof-drain cover, and a lower end of the flag is supported by a drain bowl located underneath the roof-drain cover.
Figure 23B:
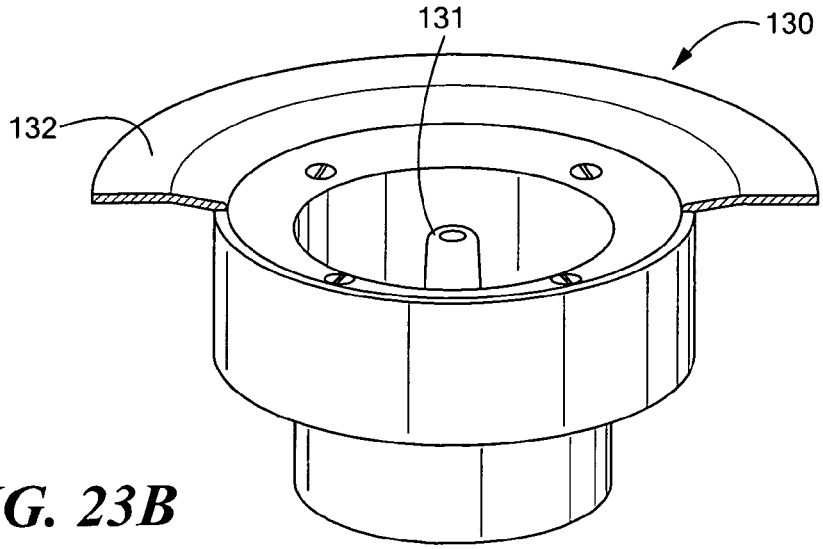

FIGS. 23A and 23B show another alternative embodiment 120 in which an elongated flag passes through a small central aperture in the roof-drain cover, and a lower end of the flag is supported by a drain bowl located underneath the roof-drain cover. The small central aperture provides lateral support at a mid-portion of the flag, and the drain bowl provides vertical support, and preferably also lateral support, at the lower end of the flag. The lower end of the flag is supported vertically by a substantially horizontal portion of the drain bowl. Preferably, the flag is reversible. Preferably, the drain bowl defines a cup-shaped support structure that is sized to accept a lower end of the flag, and thereby provide lateral support to a lower end of the flag.

FIG. 23A shows high-visibility roof-drain system 120 including roof-drain cover 121, marked reversible flag 2, and drain bowl 130. Roof-drain cover 121 defines small aperture 122, a plurality of side drain apertures 123, and a plurality of upper drain apertures 124.

FIG. 23A also shows roof-drain cover 121 mounted over drain bowl 130, and attached to drain bowl 130 by screws 134. Flange 132 of rain bowl 130 sits on concrete roof 125, and is clamped to the concrete roof by under-deck clamp 133 and screws 135.

Water leakage around the roof-drain is minimized by waterproof sheet 126 and gasket 127.

FIG. 23B shows a perspective, cut-away view of drain bowl 130. The drain bowl includes a substantially horizontal support structure 131 that provides vertical support to a lower end of the flag.

3. Subassemblies for Retrofit

The invention also provides a group of subassembly embodiments for convenience in shipping and handling. The invention provides novel flag subassemblies and novel roof-drain cover subassemblies for retrofitting a prior art roof-drain cover to make a high-visibility roof-drain cover.

A flag coupler subassembly is provided, as shown as item 37 in FIG. 13, having a marked, reversible, elongated flag, and a flag coupler having a first end and a second end, the first end defining a first cavity adapted for reversible mounting of a base portion of the flag the first cavity, the second end defining a threaded cavity sized to accept a threaded stub attached to an upper portion of a roof-drain cover.

A roof-drain cover subassembly is provided, as shown as item 38 in FIG. 13, having a roof-drain cover, typically a prior art roof-drain cover, and a coupler strip defining a central threaded stub. The coupler strip is attached to the top of the roof-drain cover. The central threaded stub is sized to couple with the threaded cavity of a flag coupler subassembly to mount the flag of a flag coupler subassembly.

What is claimed is:

1. A high-visibility roof-drain cover comprising:

a roof-drain cover;

an elongated flag; and coupler means for mounting the flag to the roof-drain cover;

such that the flag extends upwardly from the roof-drain cover a sufficient distance that a top portion of the flag will remain visible above an accumulation of wind-blown debris and snow;

wherein the flag defines a first flag end and a second flag end; wherein the first flag end is up when the second flag end is mounted to the roof-drain cover; wherein the second flag end is up when the first flag mounted to the roof-drain cover; and wherein at least one of the flag ends is visibly marked; and such that first flag end up is visibly distinguishable over second flag end up; and such that reversing the vertical orientation of the flag, after inspecting the roof-drain cover, provides a visual indication that an inspection has been performed;

wherein the flag and the cavity are sized to allow either end of the flag to fit easily into the cavity, such that the flag may be removable.

2. A high-visibility roof-drain cover according to claim 1;

wherein the roof-drain cover defines the coupler means in the shape of a boss; and wherein the boss defines a cavity sized to accept a marked, reversible, elongated flag.

3. A high-visibility roof-drain cover according to claim 1, wherein the roof-drain cover includes a prior art roof-drain cover;

wherein the coupler means includes an elongated flag coupler defining a first cavity at a first end of the flag coupler, and a threaded cavity at a second end of the flag coupler;

wherein the first cavity is sized to accept either end of a marked, reversible, elongated flag; and wherein the coupler means further includes a coupler strip with a threaded stub adapted to couple with the threaded cavity.

4. A high-visibility roof-drain cover according to claim 3, wherein the coupler strip defines at least one aperture for attachment of the coupler to the roof-drain cover.

5. A high-visibility roof-drain cover according to claim 3, wherein the threaded stub is centrally-located on the coupler strip.

6. A high-visibility roof-drain cover according to claim 3, wherein a coupler strip is attached to the second end by a spot weld.

7. A high-visibility roof-drain cover according to claim 3, wherein the coupler strip is an elongated coupler strip defining at least two tab ends; and wherein the coupler strip is attached to the roof-drain cover by the tab ends passing through apertures in the roof-drain cover.

8. A high-visibility roof-drain cover according to claim 7, wherein the coupler strip is an elongated twist-tab coupler strip defining at least two twist-tab ends; and wherein the twist-tab coupler strip is attached to the roof-drain cover by the twist-tab ends passing through apertures in the roof-drain cover, and the twist-tab ends twisted.

9. A high-visibility roof-drain cover according to claim 7, wherein the coupler strip is a spring-tab coupler strip defining at least two spring-tab ends; and wherein the spring-tab coupler strip is attached to the roof-drain cover by the spring-tab ends passing through side-wall apertures in the roof-drain cover.

10. A high-visibility roof-drain cover according to claim 1, wherein the roof-drain cover defines a grid having ribs and apertures between ribs; and the flag coupler includes a coupler plate defining one long rib-edge and one long flag-edge;

wherein the long rib-edge defines at least one rib-clasp having rib fingers; and wherein the long flag-edge defines at least one flag-clasp having flag fingers;

such that each rib-clasp grips a rib, and each flag-clasp grips the flag.

11. A high-visibility roof-drain cover according to claim 10, wherein the gripping means for gripping the flag is a roll-up flag-grip.

12. A high-visibility roof-drain cover according to claim 11, wherein the coupler means for mounting the flag to a roof-drain cover includes flag clasps.

13. A high-visibility roof-drain cover according to claim 1, wherein the coupler means is a rigid structure having a base with a peripheral rim, the rigid structure defining a cavity sized to accept either end of a marked, reversible, elongated flag; and wherein the base is sufficiently concave to fit over a convex upper portion of a roof-drain cover.

14. A high-visibility roof-drain cover according to claim 1, wherein the coupler means for mounting the flag to a roof-drain cover is a shaped-wire coupler, the shaped-wire coupler defining a coil-grip portion for accepting either end of the flag, and a locking portion for locking the shaped-wire coupler to the roof-drain cover such that the flag is held in a substantially vertical orientation.

15. A high-visibility roof-drain cover according to claim 1, wherein the high-visibility roof-drain cover includes a prior art roof-drain cover;

wherein the coupler means includes an elongated flag coupler defining a first cavity at a first end of the flag coupler; and a coupler strip at a second end of the flag coupler;

wherein the first cavity is sized to accept either end of a marked, reversible, elongated flag, and the coupler strip is adapted to couple with the roof-drain cover;

such that the flag coupler is securely attached to the roof-drain cover.

16. A high-visibility roof-drain cover according to claim 1, further comprising a locking screw that is screwed through a threaded pilot hole in a wall surrounding the cavity such that one end of the flag may be locked in place.

17. A high-visibility roof-drain cover according to claim 1, wherein the roof-drain cover is mounted above a drain bowl, and the roof-drain cover defines an aperture sized to accept the flag, such that the flag may be supported laterally within the aperture by the roof-drain cover, and supported vertically by a substantially horizontal portion of the drain bowl.

18. A high-visibility roof-drain cover subassembly, comprising:

a flag coupler with an upper end and a lower end; and a coupler strip attached to the lower end of the flag coupler;

wherein the coupler strip has a lower face shaped to conform to the shape of an upper portion of a roof-drain cover;

wherein the coupler strip includes attachment means for attaching the lower face of the coupler strip to an upper portion of a roof-drain cover; and wherein the upper end of the flag coupler defines an upper cavity adapted to accept either end of an elongated flag, to hold the flag, and to allow release of the flag.

19. A high-visibility roof-drain cover subassembly according to claim 18;

wherein the attachment means includes a coupler strip having holes spaced for alignment with apertures in an upper portion of the roof-drain cover;

such that the coupler strip may be attached to the roof-drain cover by a fastener.

20. A high-visibility roof-drain cover subassembly, according to claim 18, wherein the flag coupler includes locking means for locking the flag to the flag coupler for safety reasons.

21. A high-visibility roof-drain cover subassembly, according to claim 20, wherein the locking means includes a threaded pilot hole in a wall surrounding the upper cavity.

22. A high-visibility roof-drain cover subassembly, according to claim 18, wherein the attachment means is a threaded stub.

23. A high-visibility roof-drain cover subassembly according to claim 18;

wherein the attachment means includes a coupler strip passing through apertures in an upper portion of the roof-drain cover, the strip having at least two bent ends.

24. A high-visibility roof-drain cover subassembly, according to claim 23, wherein the flag coupler includes locking means for locking the flag to the flag coupler for safety reasons.

25. A high-visibility roof-drain cover subassembly, comprising:

a flag coupler having a coupler plate and a roll-up flag-grip for gripping a flag; and clasp means for attaching the coupler plate to a side portion of a roof-drain cover;

wherein the flag coupler includes clasp means for attaching the coupler plate to a side portion of a roof-drain cover; and wherein the upper end of the flag coupler defines an upper cavity adapted to accept either end of an elongated flag, to hold the flag, and to allow release of the flag.

26. A high-visibility roof-drain cover subassembly, according to claim 25, wherein the flag coupler includes locking means for locking the flag to the flag coupler for safety reasons.

27. A high-visibility roof-drain cover subassembly, comprising:

a flag coupler having an elongated support boss;

a plurality of struts; and a plurality of ties;

wherein the struts and the elongated support boss are joined as a rigid structure defining a peripheral rim, the rim shaped for snug attachment by ties to a convex upper portion of a prior art roof-drain cover; and wherein the upper end of the support boss defines an upper cavity adapted to accept either end of an elongated flag, to hold the flag, and to allow release of the flag.

28. A high-visibility roof-drain cover subassembly, according to claim 27, wherein the flag coupler includes locking means for locking the flag to the flag coupler for safety reasons.

29. A high-visibility roof-drain cover subassembly, comprising:

a shaped-wire flag coupler, having a first end shaped as a coil to define an elongated upper cavity, and a second end shaped to pass through apertures in a wall of a roof-drain cover;

such that the second end passing through the apertures locks the flag coupler to the roof-drain cover; and such that the elongated upper cavity accepts either end of an elongated flag, holds the flag in place, and allows release of the flag as needed.

30. A high-visibility roof-drain cover subassembly, according to claim 29;

wherein the first end shaped as a coil provides sufficient gripping for safety reasons, while allowing manual reversal of the flag.

* * * * *